US008808955B2

(12) United States Patent
Nakayama et al.

(10) Patent No.: US 8,808,955 B2
(45) Date of Patent: Aug. 19, 2014

(54) TONER AND DEVELOPMENT AGENT, IMAGE FORMING APPARATUS, AND PROCESS CARTRIDGE USING THE SAME

(75) Inventors: Shinya Nakayama, Shizuoka (JP); Atsushi Yamamoto, Shizuoka (JP); Hideyuki Santo, Shizuoka (JP); Daiki Yamashita, Kanagawa (JP); Suzuka Amemori, Shizuoka (JP); Masahide Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/608,143

(22) Filed: Sep. 10, 2012

(65) Prior Publication Data

US 2013/0078563 A1 Mar. 28, 2013

(30) Foreign Application Priority Data

Sep. 22, 2011 (JP) ..... 2011-207195

(51) Int. Cl.
*G03G 9/08* (2006.01)

(52) U.S. Cl.
USPC ..... 430/109.4; 430/108.4; 399/222

(58) Field of Classification Search
USPC ..... 430/108.4, 109.4; 399/222
See application file for complete search history.

(56) References Cited

U.S. PATENT DOCUMENTS

| | | | | |
|---|---|---|---|---|
| 7,709,173 | B2 | 5/2010 | Ohmura et al. | |
| 2007/0281234 | A1 * | 12/2007 | Isobe et al. | 430/109.1 |
| 2008/0050669 | A1 | 2/2008 | Ohmura et al. | |
| 2008/0096119 | A1 * | 4/2008 | Yamamoto et al. | 430/109.4 |
| 2008/0102395 | A1 * | 5/2008 | Ohmura et al. | 430/109.4 |
| 2010/0021839 | A1 | 1/2010 | Farrugia et al. | |
| 2010/0310979 | A1 * | 12/2010 | Ou et al. | 430/108.2 |
| 2011/0229816 | A1 * | 9/2011 | Shirai et al. | 430/109.4 |

FOREIGN PATENT DOCUMENTS

| | | | |
|---|---|---|---|
| CN | 101315528 | A | 12/2008 |
| CN | 101840169 | A | 9/2010 |
| EP | 2 328 033 | A1 | 6/2011 |
| JP | 62-70859 | | 4/1987 |
| JP | 62-70860 | | 4/1987 |
| JP | 9-22147 | | 1/1997 |
| JP | 9-329917 | | 12/1997 |
| JP | 2001-305796 | | 11/2001 |
| JP | 2006-195040 | | 7/2006 |
| JP | 2010-77419 | | 4/2010 |
| JP | 2010-139574 | | 6/2010 |
| JP | 2010-217849 | | 9/2010 |
| JP | 2012-42939 | | 3/2012 |

OTHER PUBLICATIONS

Extended European Search Report issued Jan. 3, 2013, in Patent Application No. 12185525.8

Combined Office Action and Search Report issued Jan. 13, 2014 in Chinese Patent Application No. 201210336608.2 (with English Translation of Category of Cited Documents).

* cited by examiner

*Primary Examiner* — Peter Vajda

(74) *Attorney, Agent, or Firm* — Oblon, Spivak, McClelland, Maier & Neustadt, L.L.P.

(57) ABSTRACT

A toner includes a coloring agent, a binder resin comprising a crystalline resin having a urethane skeleton and/or urea skeleton, and a releasing agent (a microcrystalline wax). A development agent, a process cartridge, and an image forming apparatus employ the toner to form images on recording media electrophotographically.

19 Claims, 4 Drawing Sheets

TONER AND DEVELOPMENT AGENT, IMAGE FORMING APPARATUS, AND PROCESS CARTRIDGE USING THE SAME

This patent application is based on and claims priority pursuant to 35 U.S.C. §119 to Japanese Patent Application No. 2011-207195, filed on Sep. 22, 2011, the entire disclosure of which is hereby incorporated by reference herein.

BACKGROUND OF THE INVENTION

1. Field of the Invention

The present invention relates to a toner and to a development agent, an image forming apparatus, and a process cartridge that use the toner.

2. Description of the Background Art

Latent images formed electrically or magnetically are typically rendered visible by an electrophotographic image forming apparatus using toner (electrophotographic toner).

For example, in electrophotography, electrostatic images (latent images) are formed on an image bearing member (typically a photoreceptor) and developed with toner to form visible toner images. The toner image is then transferred onto a transfer medium, typically paper, and thereafter fixed thereon. In the process in which the toner image is fixed on the transfer medium, a thermal fixing device such as a heating roller fixing system or a heating belt fixing system is generally used for better energy efficiency.

In recent years, demand for ever faster, more energy-efficient image forming apparatuses has continued to grow. Toner having excellent low-temperature fixing properties and providing quality images is one of the keys to satisfying such demand.

To attain a toner having excellent low-temperature fixing, binder resins forming the toner are required to have low softening temperatures. However, when the softening temperature of the binder resin is low, part of the toner image tends to adhere to the surface of the fixing device when fixing the image and transferring the image onto the transfer medium (so-called offset, also referred to as hot offset). In addition, the ability of the toner to withstand high temperatures without decomposing also deteriorates, leading to clumping (in which the toner particles stick to each other) under high-temperature conditions in particular.

Furthermore, there are other problems, such that the toner particles adhere to the inside of a development device or to carrier particles, thereby contaminating the development device or causing filming on the surface of the image bearing member.

To solve these problems, use of crystalline resins as the binder resins for toner is known. Crystalline resins quickly soften at their melting points so that it is possible to lower the softening point of the toner to around its melting points while securing excellent high-temperature stability at the melting points or temperatures lower than that. Therefore, such toner canhfittin have a good combination of low-temperature fixing and high-temperature stability.

For example, Japanese Examined Patent Application Publication Nos. H04-24702 (JP-H04-24702-A) and JP-H04-24703-A describe toners using crystalline resins elongated from a crystalline polyester by diisocyanate as the binder resins. These toners have excellent low-temperature fixing properties but insufficient hot offset resistance, which is not satisfactory in terms of the level of quality currently required.

In addition, Japanese Patent No. 3910338 (JP-3910338-B) describes toner that uses crystalline resins having a cross-linked structure by unsaturated linking containing a sulfonic acid group and can overcome hot offset. Further, Japanese Patent Application Publication No. 2010-77419 (JP-2010-77419-A) describes regulating the ratio of the softening point to the peak temperature of the melting heat and viscoelasticity to obtain an excellent combination of low-temperature fixing and high-temperature stability.

However, these toners having crystalline resins as the main component of their binder resins, although they have excellent impact resistance, also exhibit poor indentation hardness and scratch hardness. As a consequence, images output with such toners are vulnerable to abrasion such as scratching and rubbing.

JP-3360527-B describes regulating the durometer hardness of crystalline resins in the toner and including inorganic particulates in the toner to improve the stress resistance of the toner. However, the abrasion resistance of the output image is not improved. In addition, the fixing properties worsen due to the inorganic particulates, thereby degrading the low-temperature fixing of the crystalline resin

SUMMARY OF THE INVENTION

Briefly this object and other objects of the present invention as hereinafter described will become more readily apparent and can be attained, either individually or in combination thereof, by a toner that contains a coloring agent, a binder resin including a crystalline resin having a urethane skeleton and/or urea skeleton, and a releasing agent comprising a microcrystalline wax.

It is preferred that, in the toner mentioned above, in a diffraction spectrum of the toner obtained by X-ray diffraction, the ratio of C/(A+C) is 0.15 or greater, where C represents an integrated intensity of a spectrum deriving from a crystalline structure and A represents an integrated intensity of a spectrum deriving from a non-crystalline structure.

It is still further preferred that the toner mentioned above contains the binder resin including a crystalline resin having a urethane skeleton and/or urea skeleton in an amount of 50% by weight or more.

It is still further preferred that, in the toner mentioned above, the crystalline resin has a polyurethane resin obtained by elongating and/or cross-linking a di- or higher isocyanate compound and a polyester resin.

It is still further preferred that, in the toner mentioned above, the crystalline resin contains a first crystalline resin and a second crystalline resin having a weight average molecular weight Mw greater than the first crystalline resin.

It is still further preferred that, in the toner mentioned above, the second crystalline resin is obtained by elongating a modified crystalline resin having an isocyanate group at an end.

It is still further preferred that, in the toner mentioned above, the second crystalline resin is obtained by elongating a modified crystalline resin which is modified from the first crystalline resin to have a functional group reactive with an active hydrogen group.

It is still further preferred that the toner mentioned above satisfies the following relationship:

$$Ws(^\circ\,C.) \leq T(^\circ\,C.) \leq Wp(^\circ\,C.)$$

where T (° C.) represents the maximum peak temperature of melting heat of the toner measured by a differential scanning calorimeter (DSC), Wp (° C.) represents the maximum peak temperature of melting heat of the releasing agent measured by the DSC, and Ws (° C.) represents the melting starting temperature defined as a temperature at an intersection of a tangent to a DSC curve of the releasing agent measured by the DSC at a temperature at which a slope of the curve, which is a negative value, on the lower temperature side of Wp (° C.) is maximal and a straight line extrapolating a base line of the DSC curve of the releasing agent measured by the DSC.

It is still further preferred that the toner mentioned above has a penetration degree of 15 or lower at 25° C.

As another aspect of the present invention, a development agent is provided which contains a carrier and the toner mentioned above.

As another aspect of the present invention, an image forming apparatus is provided which includes a latent electrostatic image bearing member, a charger to charge the surface of the latent electrostatic image bearing member, an irradiator to irradiate the surface of the latent electrostatic image with light to form a latent electrostatic image thereon, a development device to develop the latent electrostatic image with the development agent mentioned above to form a visual image, a transfer device to transfer the visual image to a recording medium to form a transfer image thereon, and a fixing device to fix the transfer image on the recording medium.

As another aspect of the present invention, a process cartridge is provided which includes a latent electrostatic image bearing member to bear a latent electrostatic image and a development device to develop the latent electrostatic image with the development agent mentioned above to form a visual image.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT DISCLOSURE

Figure 1:
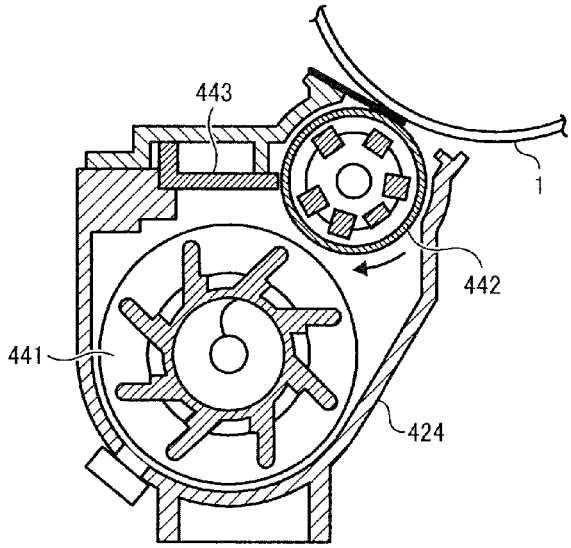
FIG. 1 is a schematic diagram illustrating an example of a two-component development agent device of the image forming apparatus of the present disclosure.

In the present invention, a toner is provided which has a binder resin having a crystalline resin having a urethane skeleton and/or urea skeleton and microcrystalline wax serving as a releasing agent. The reason why images output by using a toner having crystalline resins as the main binder resins of the toner have poor abrasion resistance is inferred to be that the lamellar layers in the crystal portion shift by the stress from outside.

By introducing a urethane skeleton and a urea skeleton into the resins, the intermolecular interaction between the lamellar layers increases, thereby reducing the shifting of the lamellar layers, resulting in increasing the hardness of the resins.

However, it is found that the hardness of the output image is not improved sufficiently simply by the introduction of a urethane skeleton and a urea skeleton but by a combination of the introduction thereof and usage of microcrystalline wax as the releasing agent.

Microcrystalline wax demonstrates a good dispersion property for the crystalline resin having a urethane skeleton and a urea skeleton and quickly phase-separates from the binder resin during thermal fixing so that the releasing agent penetrates onto the surface of the output image sufficiently even in a small amount. Therefore, the surface friction index of the output image deteriorates, which leads to production of images having excellent abrasion resistance.

The present disclosure is described in detail with reference to Embodiments.

The toner of the present disclosure contains at least a coloring agent, a binder resin, and a releasing agent. The binder resin contains a crystalline resin having a urethane skeleton and/or urea skeleton. Substantially, the main component of the binder resin is the crystalline resin.

To maximally exhibit a good combination of the low temperature fixing property and the high temperature stability by the crystalline resin, the binder resin preferably has the crystalline resin having a urethane skeleton and/or urea skeleton in an amount of 50% by weight or more, more preferably 65% by weight or more, further more preferably 80% by weight or more, and particularly preferably 95% by weight or more.

When the content of the crystalline resin is too small, the drastic thermal property of the binder resin does not easily demonstrate on the viscoelasticity of the toner so that it is difficult to have a good combination of the low temperature fixing property and the high temperature stability.

In addition, as the binder resins in the toner of the present disclosure other than the crystalline resin having a urethane skeleton and/or urea skeleton, there are crystalline resins other than the crystalline resin having a urethane skeleton and/or urea skeleton and non-crystalline resins.

There is no specific limitation to the content of the binder resin in the toner unless it inhibits the features of the binder resin. The content of the binder resin in the toner is preferably 50 parts or more, more preferably 70 parts or more, and more preferably 80 parts or more based on 100 parts of the toner.

In addition, it is suitable in terms of the combination of the fixing property and the high temperature stability that the toner has a ratio of C/(A+C) is 0.15 or greater, preferably 0.20 or greater, more preferably 0.30 or greater, and particularly preferably 0.45 or greater in the diffraction spectrum of the toner obtained by X-ray diffraction, where "C" represents an integrated intensity of a spectrum deriving from the crystalline structure and "A" represents an integrated intensity of a spectrum deriving from the non-crystalline structure.

The diffraction peak ascribable to the wax contained in the toner of the present disclosure tends to appear on the position of $2\theta=23.5°$ to 24°. However, when the content of the wax (releasing agent) in the toner is 15% by weight or less, the contribution of the diffraction peak ascribable to the wax is little and thus ignorable. When the content of the wax in the toner is greater than 15% by weight, the integrated intensity C deriving from the crystalline structure is defined as the value obtained by subtracting the integrated intensity of the spectrum deriving from the crystalline structure of the wax from the integrated intensity of the spectrum deriving from the crystalline structure.

The ratio of C/(A+C) is an index of the content of the crystalline portion, which is an area ratio of the main diffraction peak to the halo deriving from the crystalline structure in the diffraction spectrum obtained by X-ray diffraction measuring. The X-ray diffraction measuring in the present disclosure is conducted by a two-dimension detector installed X-ray diffractometer (D8 DISCOVER with GADDS, manufactured by BRUKER CORPORATION).

The capillary for use in the measuring is a wire marker (Lindemann glass) having a diameter of 0.70 mm). The sample to be measured is filled to the top of the capillary tube. When filling the sample in the tube, the tube is tapped 100 times. The detailed measuring conditions are as follows:

Tube current: 40 mA
Tube voltage: 40 kV
Goniometer 2θ axis: 20.0000°
Goniometer Ω axis: 0.0000°
Goniometer Φ axis: 0.0000°
Detector distance: 15 cm (wide angle measuring)
Measuring range: 3.2≤2θ (°)≤37.2
Measuring time: 600 sec.

Figure 5:
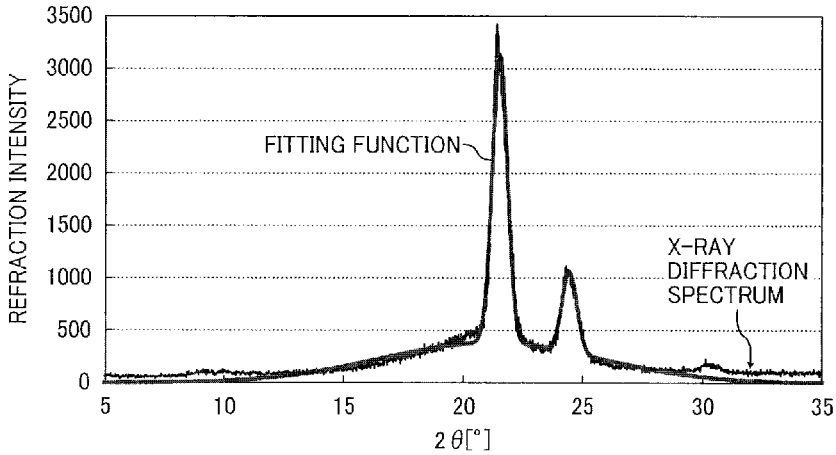
FIG. 5 is a graph illustrating a spectrum of graph illustrating an example of a diffraction spectrum obtained by X-ray diffraction measuring.
Figure 6:
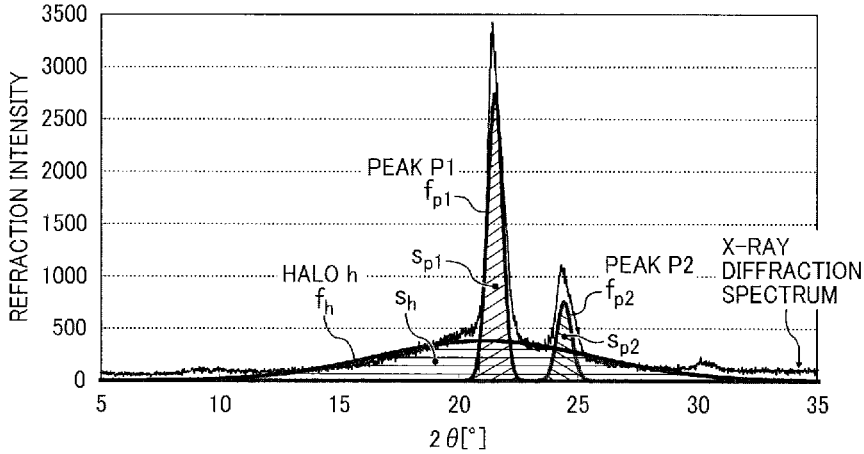
FIG. 6 is a graph illustrating descriptions for the graph of FIG. 5.

A collimator having a pinhole having a ϕ of 1 mm is used for the incident optical system. The obtained two dimensional data are integrated with attached software (with an X axis of from 3.2° to 37.2°) to convert into single dimension data of the diffraction intensity and 2θ. The ratio of C/(A+C) is calculated based on the X-ray diffraction measuring results as follows:

FIGS. 5 and 6 are graphs of an example of the diffraction spectrum obtained by the X-ray diffraction measuring. The X axis is 2θ and the Y axis is the X-ray diffraction intensity. Both are linear axes.

In the X-ray diffraction spectrum in FIG. 6, there are main peaks (P1 and P2) at 2θ of 21.3° and 24.2° and halo (h) is seen in a wide range including these two peaks. The main peaks are ascribable to the crystalline structure and, the halo, the non-crystalline structure.

These two main peaks and the halo are represented by Gaussian functions of:

$$fp1(2\theta)=ap1\exp\{-(2\theta-bp1)2/(2cp12)\} \quad \text{Relationship A1}$$

$$fp2(2\theta)=ap2\exp\{-(2\theta-bp2)2/(2cp22)\} \quad \text{Relationship A2}$$

$$fh(2\theta)=ah\exp\{-(2\theta)-bh\}2/(2ch2)\} \quad \text{Relationship A3}$$

{fp1(2θ), fp2(2θ), and fh(2θ) are the functions corresponding to the main peak P1, the main peak P2, and the halo, respectively}.

The sum of these three functions:

$$f(2\theta)=fp1(2\theta)+fp2(2\theta)+fh(2\theta) \quad \text{Relationship A4}$$

is defined as the fitting function (illustrated in FIG. 5) of the entire X-ray spectrum) where fitting is done by least-square approach.

The fitting variables are nine of ap1, bp1, cp1, ap2, bp2, cp2, ah, bh, and ch. As for the initial values for fitting for respective variables, the peak positions of the X-ray diffraction are set for bp1, bp2, and bh (bp1=21.2, bp2=24.2, bh=22.5 in FIGS. 5 and 6) and suitable values are assigned for the other variables such that the two main peaks and the halo match the X-ray diffraction spectrum as close as possible. Fitting can be conducted by, for example, Solver of Excel 2003, manufactured by MICROSOFT CORPORATION.

As for the integrated areas (Sp1. Sp2, and Sh) for the Gaussian functions fp1(2θ) and fp2(2θ) corresponding to the two main peaks P1 and P2 and the Gaussian function fh(2θ) corresponding to the halo, when (Sp1+Sp2) is defined as C and Sh is defined as A, the ratio of C/(A+C) indicating the index of the content of the crystalline portion can be calculated.

The crystalline property in the present disclosure represents a characteristic which drastically softens by heat with a ratio (softening temperature to the maximum peak temperature of the melting heat) of the softening temperature measured by a flow tester to the maximum peak temperature measured by a differential scanning calorimeter of from 0.8 to 1.55 and a resin having this characteristic is defined as the crystalline resin in the present disclosure.

In addition, the non-crystalline property represents a characteristic which slowly softens by heat with a ratio (softening temperature to the maximum peak temperature of the melting heat) of the softening temperature measured by a flow tester to the maximum peak temperature measured by a differential scanning calorimeter of greater than 1.55 and a resin having this characteristic is defined as the non-crystalline resin in the present disclosure.

The crystalline resin of the present disclosure preferably has a maximum peak temperature of the melting heat of from 45° C. to 70° C., more preferably from 53° C. to 65° C., and furthermore preferably from 58° C. to 62° C. in terms of having a good combination of the low temperature fixing property and the high temperature stability.

When the maximum peak temperature is too low, the low temperature fixing property is improved but the high temperature stability tends to deteriorate. When the maximum peak temperature is too high, the high temperature stability is improved but the low temperature fixing property tends to deteriorate.

The ratio (the softening temperature to the maximum peak temperature of the melting heat) of the softening temperature to the maximum peak temperature of the melting heat of the crystalline resin is from 0.8 to 1.55, preferably from 0.85 to 1.25, more preferably from 0.9 to 1.2, and furthermore preferably from 0.9 to 1.19.

A resin with this ratio having a small value has a characteristic of drastic softening and is excellent in terms of having a good combination of the low temperature fixing property and the high temperature stability.

The softening temperature of the resin and the toner can be measured by a flow tester (e.g., CFT-500D, manufactured by SHIMADZU CORPORATION) as follows:

Impart a load of 1.96 MPa to one gram of a sample resin by a plunger while heating the sample resin at a temperature rising speed of 6° C./min. to extrude it from a nozzle having a diameter of 1 mm and a length of 1 mm; Plot the plunger descending amount of the flow tester against the temperature; and determine the temperature at which a half of the sample has flown out as the softening temperature.

The maximum peak temperature of the melting heat of the resin for use in the present disclosure can be measured by a differential scanning calorimeter (DSC) (for example, TA-60W and DSC-60, manufactured by SHIMADZU CORPORATION) as follows:

As preliminary treatment, melt the sample supplied to the measurement of the maximum peak temperature of the melting heat at 130° C.; cool it down from 130° C. to 70° C. at a temperature falling speed of 1.0° C./min.; Cool it down from 70° C. to 10° C. at a temperature falling speed of 10° C./min.;

Heat the sample by a DSC at a temperature rising speed of 20° C./min. once to measure the change of absorption and generation of heat; Draw a graph of "amount of absorption and generation of heat" and "temperature"; Define the endotherm peak temperature observed between 20° C. to 100° C. as "Ta*".

If there are multiple endotherm peaks, the temperature at which the amount of endotherm is the largest is determined as Ta*;

Thereafter, preserve the sample at (Ta*−10) ° C. for six hours and at (Ta*−15) ° C. for another six hours;

Then, cool down the sample by DSC to 0° C. at a temperature falling speed of 0.5° C./min.; Heat it at a temperature rising speed of 20° C./min. to measure the change of absorption and generation of heat; Draw a graph as described above; Determine the temperature corresponding to the maximum peak of the amount of absorption and generation of heat as the maximum peak temperature of the melting heat.

With regard to the viscoelasticity of the crystalline resin, the storage elastic modulus G' of the crystalline resin at (maximum peak temperature of the melting heat+20° C.) is preferably $5.0\times10^6$ Pa·s or less, more preferably from $1.0\times10^1$ Pa·s to $5.0\times10^5$ Pa·s, and furthermore preferably from $1.0\times10^1$ Pa·s to $1.0\times10^4$ Pa·s.

The loss elastic modulus G" of the crystalline resin at (maximum peak temperature of the melting heat+20° C.) is preferably $5.0\times10^6$ Pa·s or less, more preferably from $1.0\times10^1$ Pa·s to $5.0\times10^5$ Pa·s, and furthermore preferably from $1.0\times10^1$ Pa·s to $1.0\times10^4$ Pa·s.

With regard to the viscoelasticity of the toner for use in the present disclosure, the storage elastic modulus G' and the loss elastic modulus G" preferably range from $1.0\times10^3$ Pa·s to $5.0\times10^6$ Pa·s in terms of the fixing strength and the hot-offset resistance. Considering that the coloring agent and laminate inorganic minerals are dispersed in the binder resin, which leads to an increase in the storage elastic modulus G' and the loss elastic modulus G", the viscoelasticity of the crystalline resin is preferably in the range specified above.

The viscoelasticity of the crystalline resin can be obtained by, for example, adjusting the ratio between the crystalline monomer and the non-crystalline monomer constituting the resin and the molecular weight thereof. For example, the storage elastic modulus G' of the crystalline resin at (maximum peak temperature of the melting heat Ta*+20° C.) becomes small as the ratio of the crystalline monomer increases.

The dynamic viscoelasticity characteristic values (the storage elastic modulus G' and the loss elastic modulus G") of the resin and the toner can be measured by a dynamic viscoelasticity measuring device (for example, ARES, manufactured by TA INSTRUMENT JAPAN INC.). The measuring is conducted at a frequency of 1 Hz.

Mold the sample to a pellet having a diameter of 8 mm and a thickness of from 1 mm to 2 mm; Fix the pellet to a parallel plate having a diameter of 8 mm; Stabilize it at 40° C.; and heat it at a frequency of 1 Hz (6.28 rad/s) with a distortion amount (distortion amount control mode) of 0.1% to 200° C. at a temperature rising speed of 2.0° C./min. for measurement.

The weight average molecular weight (Mw) of the crystalline resin is preferably from 2,000 to 100,000, more preferably from 5,000 to 60,000, and particularly preferable from 8,000 to 30,000 in light of the fixing property.

When the molecular weight is too small, the hot offset resistance tends to deteriorate and when the molecular weight is too large, the low temperature fixing property tends to deteriorate.

In the present disclosure, the weight average molecular weight (Mw) of the resin can be measured by using a gel permeation chromatography (GPC) measuring device (for example, GPC-8220 GPC, manufactured by TOSOH CORPORATION).

The column is TSK gel Super HZM-M 15 cm triplet (manufactured by TOSOH CORPORATION).

Dissolve the resin to be measured in tetrahydrofuran (THF) (stabilizing agent contained, manufactured by WAKO PURE CHEMICAL INDUSTRIES, Ltd.) to obtain a 0.15% by weight solution followed by filtration with a 0.2 μm filter. Use the filtrate as a sample (THF sample solution).

Infuse 100 μl of the THF sample solution into the measuring instrument under the condition that the temperature is 40° C. and the flow speed is 0.35 ml/min.

Calculate the molecular weight of the sample by the relationship between the logarithm value of the standard curve made from several kinds of the monodispersed polystyrene standard samples and the count value.

The monodispersed polystyrene standard samples are: Showdex STANDARD Std. No S-7300, S-210, S-390, S-875, S-1980, S10.9, S-629, S-3.0, and S-0.580 (manufactured by SHOWA DENKO K.K) and toluene.

A refractive index (RI) detector is used as the detector.

Any crystalline resin having a urethane skeleton and/or a urea skeleton that satisfies the conditions is suitably used. Specific examples thereof include, but are not limited to, polyester resins, polyurethane resin, polyurea resins, polyamide resins, and complex resins thereof that have a urethane skeleton and/or a urea skeleton.

In particular, polyurethane resins or polyurea resins obtained by elongation and/or cross-linking reaction of a polyester resins and a di- or higher isocyanate compound have such an excellent hardness that they are preferable in terms of penetration of the releasing agent in the present disclosure.

In addition, among the polyester resins, straight chain polyester resins and complex resins that contains the straight chain polyester resins are preferable in terms of crystallinity.

Among the polyester resins, polycondensed polyester resins synthesized from a diol component and a dicarboxylic acid component are preferable in terms of exhibition of crystallinity. Optionally, tri- or higher alcohol components and carboxylic acid components can be used.

In addition, among the polyester resins, in addition to the polycondensed polyester resins, lactone ring-opening polymers and polyhydroxycaroboxylic acids are also preferable.

In addition, resins synthesized from a diol component and dicarboxylic acid component having a urethane skeleton or a urea skeleton can be suitably used as the polyester resin having a urethane skeleton and/or a urea resin.

Among the polyurethane resins, polyurethane resins synthesized from a diol component and a diisocyanate component are suitably used. Optionally, tri- or higher alcohol components and isocyanate components can be used.

Among the polyurea resins, polyurea resins synthesized from a diamine component and a diisocyanate component are suitably used. Optionally, tri- or higher amine components and isocyanate components can be used.

Among the polyamide resins, polyamide resins synthesized from a diamine component and a dicarboxylic acid component are suitably used. Optionally, tri- or higher amine components and carboxylic acid components can be used.

Next, the alcohol component, the carboxylic acid component, the isocyanate component, and the amine component for use in these crystalline polycondensed polyester resins, crystalline polyurethane resins, crystalline polyamide resins, and crystalline polyurea resins are described below.

As the alcohol component, aliphatic diols are preferable as the polyalcohol component and the number of carbon atoms in the chain is preferably from 2 to 36.

The aliphatic diols are classified into the straight chain type and the branch-chain type. The straight chain aliphatic diols are preferable.

As the diol component, multiple diol components can be used. The content of the straight-chain type aliphatic diols is preferably 80% by mol or higher and more preferably 90% by mol or higher based on the total content of the diol component.

When the content is 80% by mol or higher, the crystallinity of the resin is improved, the combination of the low temperature fixing property and the high temperature stability is good, thereby ameliorating the resin hardness.

Specific examples of the straight chain type aliphatic diols include, but are not limited to, ethylene glycol, 1,3-propane diol, 1,4-butane diol, 1,5-pentane diol, 1,6-hexane diol, 1,7 heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosane diol. Among these, considering the availability, ethylene glycol, 1,3-propane diol, 1,4-butane diol, 1,6-hexane diol, 1,9-nonane diol, and 1,10-decane diol are preferable.

Specific examples of the optional diols include, but are not limited to, aliphatic diols having 2 to 36 carbon atoms other than the specified above (e.g., 1,2-propylene glycol, butane diol, hexane diol, octane diol, decane diol, dodecane diol, tetradecane diol, neopentyl glycol, and 2,2-diethyl-1,3-propane diol); alkylene ether glycols having 4 to 36 carbon atoms (e.g., diethylene glycol, triethylene glycol, dipropylene glycol, polyethylene glycol, polypropylene glycol, and polytetramethylene ether glycol); alicyclic diols having 4 to 36 carbon atoms (e.g., 1,4-cyclohexane dimethanol and hydrogenated bisphenol); Adducts of the alicyclic diols specified above with 1 mol to 30 mols of alkylene oxide (hereinafter referred to as AO) such as ethylene oxide (hereinafter referred to as EO), propylene oxide (hereinafter referred to as PO), and butylene oxide (hereinafter referred to as BO); adducts of bisphenols (e.g., bisphenol A, bisphenol F, and bisphenol S) with 2 mols to 30 mols of AO (EO, PO, BO, etc.); polylactone diols (e.g., polyε-caprolactone diol); and polybutadiene diol).

In addition, diols having other functional groups can be also used. Specific examples thereof include, but are not limited to, diols having carboxyl groups, diols having sulfonic acid groups or sulfamic acid groups, and salts thereof.

Specific examples of the diols having carboxyl groups include, but are not limited to, dialkylol alkane acid (C6 to C24, for example, 2,2-dimethylol propionic acid (DMPA), 2,2-dimethylol butane acid, 2,2-dimethylol heptane acid, and 2,2-dimethylol octane acid).

Specific examples of the diols having sulfonic acid groups or sulfamic acid groups include, but are not limited to, sulfamic diols such as [N,N-bis(2-hydroxyalkyl) sulfamate (alkyl group having one to six carbon atoms) and adducts thereof with 1 mol to 6 mols of AO (EO, PO, etc.).

As neutralizing bases of the diols having these neutralizing base groups, tertiary amines (e.g., triethyl amine) having 3 to 30 carbon atoms and/or alkali metal (sodium salts) can be specified. Among these, it is preferable to use an alkylene glycol having 2 to 12 carbon atoms, a diol having a carboxyl group, an adduct of a bisphenol with AO, and a combination thereof.

Specific examples of the optional tri- or higher alcohol components include, but are not limited to, tri- or higher aliphatic polyols having 3 to 36 carbon atoms (e.g., alkane polyols and inner or inter molecular dehydrated compounds thereof, e.g., glycerine, trimethylol ethane, trimethylol propane, pentaerythritol, sorbitol, sorbitane, and polyglycerine); Sugars and derivatives thereof (e.g., sucrose and methyl glucoside); adducts of trisphenols (e.g., triphenol PA) with 2 mols to 30 mols of AO; adducts of novolac resins (e.g., phenolic novolac and cresol novolac) with 2 mols to 30 mols of AO; and copolymers of acrylic polyol (e.g., copolymers of hydroxyethyl (meth)acrylate and another vinyl-based monomer).

Among these, tri- or higher aliphatic polyols and adducts of novolac resins with AO are preferable and adducts of novolac resins with AO are more preferable.

Preferred specific examples of the carboxylic acid components include, but are not limited to, aliphatic dicarboxylic acids and aromatic dicarboxylic acids.

The aliphatic dicarboxylic acids are classified into the straight chain type and the branch-chained type.

The straight chain type dicarboxylic acids are more preferable.

Specific examples of the dicarboxylic acid include, but are not limited to, alkane dicarboxylic acids having 4 to 36 carbon atoms such as succinic acid, adipic acid, sebacic acid, azelaic acid, dodecane dicarboxylic acid, octadecane dicarboxylic acid, and decyl succinic acid; alicyclic dicarboxylic acids having 6 to 40 carbon atoms such as dimer acid (dimerized linolic acid); alkene dicarboxylic acids having 4 to 36 carbon atoms such as alkenyl succinic acids such as dodecenyl succinic acid, pentadecenyl succinic acid, and octadecenyl succinic, maleic acid, fumaric acid, and citraconic acid; and aromatic dicarboxylic acids having 8 to 36 carbon atoms such as phthalic acid, isophthalic acid, terephthalic acid, t-butyl isophthalic acid, 2,6-naphthalene dicarboxylic acid, and 4,4'-biphenyl dicarboxylic acid).

Specific examples of the optional polycarboxylic acids having three or more hydroxyl groups include, but are not limited to, aromatic polycarboxylic acids having 9 to 20 carbon atoms (e.g., trimellitic acid and pyromellitic acid).

Specific examples of the dicarboxylic acid or tri- or higher polycarboxylic acids include, but are not limited to, anhydrides or lower alkyl esters having one to four carbon atoms (e.g., methyl esters, ethyl esters and isopropyl esters) of the above-specified.

Among these dicarboxylic acids, it is particularly preferable to use the aliphatic dicarboxylic acids (preferably adipic acid, sebacic acid, dodecane dicarboxylic acid, terephthalic acid, and isophthalic acid) singly. Copolymers of the aliphatic dicarboxylic acids and the aromatic dicarboxylic acids (preferably isophthalic acid, terephthalic acid, t-butyl isophthalic acid, and lower alkyl esters thereof) are also preferable.

The amount of copolymerized aromatic dicarboxylic acid is preferably 20% by mol or less.

Specific examples of the isocyanate compounds include, but are not limited to, aromatic isocyanates, aliphatic isocyanates, alicyclic isocyanates, and aromatic aliphatic isocyanates (among these, for example, aromatic diisocyanates having 6 to 20 carbon atoms, aliphatic diisocyanates having 2 to 18 carbon atoms, alicyclic diisocyanates having 4 to 15 carbon atoms, aromatic aliphatic diisocyanates having 8 to 15 carbon atoms, modified diisocyanates thereof (modified compounds having a urethane group, a carbodiimide group, an allophanate group, a urea group, a biuret group, a uretdione group, a uretimine group, an isocyanulate group, and an oxazoline group), and mixtures thereof, in which he number of carbon atoms specified above excludes the number of carbon atoms in NCO group).

Optionally, tri- or higher isocynates can be used in combination therewith.

Specific examples of the aromatic isocyanates include, but are not limited to, 1,3- and/or 1,4-phenylene diisocyanate, 2,4- and/or 2,6-trilene diisocyanate (TDI), crude TDI, 2,4'- and/or 4,4'-diphenyl methane diisocyanate (MDI), crude MDI (phosgenized compound of crude diamino diphenyl methane (condensed products of formaldehyde and aromatic amine (aniline) or its mixture; mixtures of diamino diphenyl methane with a small quantity (e.g., 5% by weight to 20% by weight) of tri- or higher polyamines), aryl polyisocyanate (PAPI), 1,5-naphthylene diisocyanate, 4,4'4"-triphenyl methane triisocyanate, and m- or p-isocyanato phenyl sulfonyl isocyanate.

Specific examples of the aliphatic isocyanates include, but are not limited to, ethylene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyanato methyl caproate, bis(2-isocyanato ethyl) fumarate, bis(2-isocyanato ethyl) carbonate, and 2-isocyanatoethyl-2,6-diisocyanato hexanoate.

Specific examples of the alicyclic isocyanates include, but are not limited to, isophorone diisocyanate (IPDI), dicyclo hexyl methane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- and/or 2,6-norbornane diisocyanate.

Specific examples of the aromatic aliphatic diisocyanates include, but are not limited to, m- and/or p-xylylene diisocyanate (XDI), α,α,α',α'-tetramethyl xylylene diisocyanate (TMXDI).

Specific examples of the modified compounds of the diisocyanates include, but are not limited to, modified compounds having a urethane group, a carbodiimide group, an allophanate group, a urea group, a biuret group, a uretdione group, a uretimine group, an isocyanulate group, and an oxazoline group.

To be specific, these are: modified MDI such as urethane modified MDI, carbodiimide modified MDI, and trihydrocarbyl phosphate modified MDI), modified compounds of diisocyanates such as urethane modified TDI, and mixtures thereof such as modified MDI and urethane modified TDI (prepolymer containing isocyanate).

Among these, aromatic diisocyanates having 6 to 15 carbon atoms, aliphatic diisocyanates having 4 to 12 carbon atoms, alicyclic diisocyanates having 4 to 15 carbon atoms are preferable, in which the number of carbon atoms excludes the number of carbon atoms in NCO group. Among these, TDI, MDI, HDI, hydrogenated MDI, and IPDI are particularly preferable.

Specific examples of the amine component include, but are not limited to, aliphatic amines and aromatic amines. Among these, aliphatic diamines having 2 to 18 carbon atoms and aromatic diamines having 6 to 20 carbon atoms are suitable. Optionally, tri- or higher amines can be used.

Specific examples of the aliphatic diamines having 2 to 18 carbon atoms include, but are not limited to, alkylene diamines such as ethylene diamine, propylene diamine, trimethylene diamine, tetramethylene diamine, and hexamethylene diamine; polyalkylene diamines having 4 to 18 carbon atoms such as diethylene triamine, iminobis propyl amine, bis(hexamethylene)triamine, triethylene tetramine, tetraethylene pentamine, and pentaethylene hexamine; substituted compounds thereof with an alkyl having 1 to 4 carbon atoms or a hydroxyl alkyl having 2 to 4 carbon atoms such as dialkyl aminopropyl amine, trimethyl hexamethylene diamine, aminoethyl ethanol amine, 2,5-dimethyl-2,5-hexamethylene diamine, and methyl iminobispropyl amine; alicyclic or heterocyclic aliphatic diamines such as alicyclic diamine having 4 to 15 carbon atoms such as 1,3-diamino cyclohexane, isophorone diamine, menthene diamine, 4,4'-methylene dicyclohexane diamine (hydrogenated methylene dianiline and heterocyclic diamine having 4 to 15 carbon atoms such as piperazine, N-aminoethyl piperazine, 1,4-diaminoethyl piperazine, 1,4,-bis(2-amino-2-methylpropyl) piperazine, 3,9-bis (3-aminopropyl)-2,4,8,10-tetraoxaspiro[5,5]undecane; and aromatic aliphatic amines having 8 to 15 carbon atoms such as xylylene diamine, tetrachloro-p-xylylene diamine.

Specific examples of the aromatic diamines having 6 to 20 carbon atoms include, but are not limited to, non-substituted aromatic diamines such as 1,2-, 1,3, or 1,4-phenylene diamine, 2,4,'- or 4,4'-diphenyl methane diamine, crude diphenyl methane diamine (polyphenyl polymethylene polyamine), diaminodiphenyl sulfone, bendidine, thiodianiline, bis(3,4-diaminophenyl) sulfone, 2,6-diaminopilidine, m-aminobenzyl amine, triphenyl methane-4,4',4"-triamine, and naphthylene diamine; aromatic diamines having a nuclear substitution alkyl group having one to four carbon atoms such as 2,4- or 2,6-trilene diamine, crude trilene diamine, diethyl trilene diamine, 4,4'-diamino-3,3'-dimethyldiphenyl methane, 4,4'-bis(o-toluidine), dianisidine, diamino ditolyl sulfone, 1,3-dimethyl-2,4-diaminobenzene, 1,3-dimethyl-2,6-diaminobenzene, 1,4-diisopropyl-2,5-diamino benzene, 2,4-diamino mesitylene, 1-methyl-3,5-diethyl-2,4-diamino benzene, 2,3-dimethyl-1,4-diamino naphthalene, 2,6-dimethyl-1,5-diamino naphthalene, 3,3',5,5'-tetramethyl bendizine, 3,3',5,5'-tetramethyl-4,4'-diamino diphenyl methane, 3,5-diethyl-3'-methyl-2',4-diamino diphenyl methane, 3,3'diethyl-2,2'-diaminodiphenyl methane, 4,4'-diamino-3,3'-dimethyl diphenylmethane, 3,3',5,5'-tetraethyl-4,4'-diaminobenzophenone, 3,3',5,5'-tetraethyl-4,4'-diaminodiphenyl ether, 3,3',5,5'-tetraisopropyl-4,4'-diaminophenyl sulfone; mixtures of isomers thereof with various ratios; aromatic diamines having a nuclear substitution electron withdrawing group (such as halogen (e.g., Cl, Br, I, and F), alkoxy groups such as methoxy group and ethoxy group, and nitro group) such as methylene bis-o-chloroaniline, 4-chlor-o-phenylene diamine, 2-chlor-1,4-phenylene diamine, 3-amino-4-chloroaniline, 4-bromo-1,3-phenylene diamine, 2,5-dichlor-1,4-phenylene diamine, 5-nitro-1,3-phenylene diamine, 3-dimethoxy-4-aminoaniline, 4,4'-diamino-3,3'-dimethyl-5,5'-dibromo-diphenyl methane, 3,3'-dichlorobenzidine, 3,3'dimethoxy benzidine, bis(4-amino-3-chlorophenyl)oxide, bis(4-amino-2-chlorophenyl)propane, bis(4-amino-2-chlorophenyl) sulfone, bis(4-amino-3-methoxyphenyl) decane, bis(4-aminophenyl)sulfide, bis(4-aminophenyl) telluride, bis(4-aminophenyl) selenide, bis(4-amino-3-methoxyphenyl) disulfide, 4,4'-methylene bis(2-iodoaniline), 4,4'-methylene bis (2-bromoaniline), 4,4'-methylene bis(2-fluoroaniline), 4-aminophenyl-2-chloroaniline); aromatic diamines having a secondary amino group such as the non-substituted aromatic diamines specified above, the aromatic diamines having a nuclear substitution alkyl group having one to four carbon atoms, mixtures of isomers thereof with various mixing ratio, compounds in which part or entire of the primary amine group of the aromatic diamines having a nuclear substitution electron withdrawing group specified above is substituted with a lower alkyl group such as methyl group and ethyl group to be a tertiary amino group, 4-4'-di (methylamino)diphenyl methane, and 1-methyl-2-methylamino-4-aminobenzene.

In addition to those, specific examples of the diamines include, but are not limited to, polyamide polyamines (low-molecular weight polyamide polyamines obtained by condensation of dicarboxylic acid (e.g., dimeric acid) and excessive (2 mols or more per mol of acid) polyamines (e.g., the alkylene diamines specified above and polyalkylene polyamines specified above) and hydrogenated compounds of cyanoethylated polyether polyamines (e.g., polyether polyols such as polyalkylene glycol).

The lactone ring-opening polymers as the polyester resin can be obtained by, for example, ring-opening polymerizing a lactone such as a monolactone (the number of ester groups is one in the ring) having 3 to 12 carbon atoms such as β-propio lactone, γ-butylo lactone, δ-valero lactone, and ϵ-capro lactone using a catalyst such as a metal oxide and an organic metal compound.

Among these, ϵ-capro lactone is preferable in terms of crystallinity.

In addition, lactone ring-opening polymers having a hydroxyl group at their end obtained by ring-opening polymerizing the lactones specified above using a glycol (e.g., ethylene glycol and diethylene glycol) as an initiator are suitable. Also the end can be modified to be a carboxyl group.

Products available from the market can be also used. These are, for example, high-crystalline polycapro lactones such as PLACCEL series H1P, H4, H5, and H7 (manufactured by DAICEL CORPORATION).

Polyhydroxy carboxylic acids as the polyester resins are obtained by direct dehydrocondensation of hydroxycarboxylic acid such as a glycolic acid, lactic acid (L-, D- and racemic form). However, it is preferable to obtain them by ring-opening a cyclic ester (the number of ester groups in the ring is two or three) having 4 to 12 carbon atoms corresponding to an inter two or three molecule dehydrocondensed compound of a hydroxycarboxylic acid such as glycolide and lactide (L-, D- and racemic form) with a catalyst such as a metal oxide and an organic metal compound in terms of controlling the molecular weight.

Among these, preferable cyclic esters are L-lactide and D-lactide in light of crystallinity.

In addition, these polyhydrocarboxylic acids that are modified to have a hydroxy group or a carboxylic group at the end are also suitable.

Block resins that have crystalline portions and non-crystalline portions are suitable as the crystalline resin of the present disclosure. The crystalline resins specified above can be used for the crystalline portions.

As resins for use in forming the non-crystalline portions, specific examples thereof include, but are not limited to, polyester resins, polyurethane resins, polyurea resins, and polyamide resins.

The composition of these non-crystalline portions is the same as that of the crystalline portion. Specific examples of the monomer for use include, but are not limited to, the diol components specified above, the dicarboxylic acid components specified above, the diisocyanate components specified above, and the diamine components specified above. Any combination thereof that can form a non-crystalline resin is suitable.

The crystalline resins of the present disclosure may contain a crystalline resin obtained by elongation reaction or cross-linking reaction during granulation in an aqueous medium using a modified crystalline resin having a functional group reactive with an active hydrogen group as a binder resin precursor. The crystalline resins specified above can be used as the modified crystalline resin.

The modified crystalline resin can increase its molecular weight by reaction with a resin having an active hydrogen group or a compound such as a cross-linking agent or an elongation agent having an active hydrogen group during the toner manufacturing process.

There is no specific limit to the functional group reactive with an active hydrogen group.

Specific examples thereof include, but are not limited to, functional groups such as an isocyanate group, an epoxy group, a carboxylic acid group, and an acid chloride group. Among these, an isocyanate group is preferable in terms of the reaction property and the stability.

Specific examples of the modified crystalline resins include, but are not limited to, crystalline polyester resins, crystalline polyurethane resins, crystalline polyurea resins, and crystalline polyamide resins that have the above-specified functional group reactive with an active hydrogen group.

There is no specific limitation to compounds such as the above-specified resin having an active hydrogen group and the above-specified cross-lining agent or elongation agent having an active hydrogen group and any compound having an active hydrogen group is suitably used.

When the above-specified functional group reactive with an active hydrogen group is isocyanate group, the active hydrogen group is hydroxyl group (alcoholic hydroxyl group and phenolic hydroxyl group), amino group, carboxyl group, mercapto group, etc. Amines are preferable in terms of the reaction speed.

A resin obtained by reacting the modified crystalline resin having an isocyanate group at the end with an amine becomes a crystalline resin having a urethane skeleton and/or urea skeleton.

There is no specific limitation to the amines. Specific examples thereof include, but are not limited to, phenylene diamine, diethyltoluene diamine, 4,4'-diamino diphenyl methane, 4,4'-diamino-3,3'-dimethyldicyclo hexylmethane, diamine cyclohexane, isophorone diamine, ethylene diamine, tetramethylene diamine, hexamethylene dimaine, diethylene triamine, triethylene tetramine, ethanol amine, hydroxyethyl aniline, aminoethyl mercaptan, aminopropyl mercaptan, amino propionic acid, and amino caproic acid.

In addition, ketimine compounds and oxazolidine compounds in which these amino groups are blocked with ketones (acetone, methylethyl ketone, and methylisobutyl ketone) are also suitable.

The crystalline resin in the present disclosure preferably has a first crystalline resin and a second crystalline resin having a weight average molecular weight (Mw) greater than that of the first crystalline resin.

By imparting the low temperature fixing property to the first crystalline resin and the hot offset resistance to the second crystalline resin, the two competing characteristics can be functionally separated so that a toner having a wide temperature range with regard to fixing can be obtained.

In addition, the second crystalline resin is preferably a resin obtained by elongating the modified crystalline resin having an isocyanate group. This is advantageous to form a crystalline resin having a high molecular weight in the binder resin.

The second crystalline resin is preferably a resin obtained by elongating a modified crystalline resin having a functional group reactive with an active hydrogen group prepared by modifying the first crystalline resin.

The second crystalline resin is uniformly finely-dispersed in the binder resin so that a toner having an excellent combination of the low temperature fixing property and the hot offset resistance is obtained.

The weight average molecular weight of the first crystalline resin is preferably from 2,000 to 100,000, more preferably from 5,000 to 60,000, and particularly preferable from 8,000 to 30,000 in light of the fixing property.

When the molecular weight is too small, the hot offset resistance tends to deteriorate and when the molecular weight is too large, the low temperature fixing property tends to deteriorate.

The weight average molecular weight of the second crystalline resin is preferably larger than that of the first crystalline resin and preferably from 10,000 to 1,000,000, more preferably from 30,000 to 1,000,000, and particularly preferable from 50,000 to 500,000 in light of the hot offset resistance.

When the molecular weight is too small, the hot offset resistance tends to deteriorate and when the molecular weight is too large, the low temperature fixing property tends to deteriorate.

Any binder resin can be used in the present disclosure. The crystalline resin and the non-crystalline resin can be used in combination.

There is no specific limit to non-crystalline resin. Any resin having a non-crystalline property can be suitably used.

Specific examples thereof include, but are not limited to, styrene mono-polymers and substituted styrene polymers such as polystyrene, poly-p-styrene, and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ether copolymers, styrene-vinyl methyl ketone copolymers, styrene-butadiene copolymers, styrene-isopropyl copolymers, and styrene-maleic acid ester copolymers; other resins such as polymethyl methacrylate resins, polybutyl methacrylate resins, polyvinyl chloride resins, polyvinyl acetate resins, polyethylene resins, polyesters resins, polyurethane resins, epoxy resins, polyvinyl butyral resins, polyacrylic resins, rosin resins, modified rosin resins, terpene resins, phenolic resins, aliphatic or aromatic hydrocarbon resins, and aromatic petroleum resins, and resins modified to have a functional group reactive with an active hydrogen group. These resins can be used alone or in combination.

The binder resin precursor in the present disclosure represents monomers or oligomers forming the binder resin specified above, the above-specified modified resins modified to have a functional group reactive with an active hydrogen group, and compounds including oligomers that can conduct elongation reaction or cross-linking reaction. Any crystalline resin or no-crystalline resin is suitable.

The releasing agent in the present disclosure is limited to microcrystalline wax. The microcrystalline wax is a kind of the petroleum wax separated and refined from reduced-pressure distillation residual of crude oil and a releasing agent containing isoparaffin and cycloparaffin in a large amount in addition to normal paraffin.

The microcrystalline wax has an excellent dispersion property for the crystalline resin for use in the present disclosure and penetrates quickly into the surface of a fixed image to cover the surface thereof when the toner is melted by thermal fixing so that the obtained image has an excellent abrasion resistance.

There is no specific limit to the maximum peak temperature of the melting heat of the microcrystalline wax. The maximum peak temperature is normally from 55° C. to 90° C., preferably from 60° C. to 80° C., and particularly preferably from 60° C. to 70° C.

A maximum peak temperature that is too low tends to have an adverse impact on the hardness and the high temperature stability of toner. A maximum peak temperature that is too high tends to degrade the penetrating property of the releasing agent during fixing, thereby reducing the advantage of the present disclosure.

The maximum peak temperature T (° C.) of the melting heat of the toner of the present disclosure, the maximum peak temperature Wp (° C.) of the melting heat of the releasing agent, and the melting starting temperature Ws (° C.) of the releasing agent can be measured by a differential scanning calorimeter (DSC) (for example, TA-60W and DSC-60, manufactured by SHIMADZU CORPORATION).

The sample supplied to the measuring is heated from 0° C. to 150° C. at a temperature rising speed of 10° C./min., then cooled down to 0° C. at a temperature falling speed of 10° C./min., and heated again from 0° C. at a temperature rising speed of 10° C./min. to obtain a DSC curve (second DSC). From the curve, the temperature corresponding to the maximum peak of absorption amount of heat is determined as the maximum peak temperature T or Wp of the melting heat.

In addition, the melting starting temperature Ws (° C.) of the releasing agent is defined in the second DSC curve of the releasing agent as the temperature at the intersection of the tangent at the temperature at which the slope of the curve (slope is a negative value) is maximum and the straight line extrapolating the base line on the side of the temperatures lower than the maximum peak temperature Wp of the absorption amount of heat.

The maximum peak temperature T (° C.) of the melting heat of the toner of the present disclosure, the maximum peak temperature Wp (° C.) of the melting heat of the releasing agent, and the melting starting temperature Ws (° C.) of the melting heat of the releasing agent preferably satisfy the following relationship: $Ws \leq T \leq Wp$.

By satisfying the relationship, the releasing agent efficiently penetrates into the surface at the same time when the toner melts, resulting in improvement in the abrasion resistance of the output image.

The releasing agent preferably has a melt viscosity of from 5 cps to 1,000 cps and more preferably from 10 cps to 100 cps at a temperature 20° C. higher than the melting point of the wax (releasing agent).

When the melt viscosity is too low, the releasing property may deteriorate. When the melt viscosity is too high, the effect of improving the hot offset resistance and the low temperature fixing property may be reduced.

There is no specific limitation to the difference (Wp−Ws) (° C.) between the maximum peak temperature Wp (° C.) of the melting heat of the releasing agent and the melting starting temperature Ws (° C.) of the melting heat of the releasing agent.

The difference is normally 40° C. or less, preferably from 10° C. to 30° C., and particularly preferably from 10° C. to 20° C.

When the difference is too large, the penetrating property of the releasing agent tends to deteriorate.

The (needle) penetration degree of the releasing agent at 25° C. is preferably 20 or less and particularly preferably 15 or less in terms of the hardness of the toner.

In addition, the penetration degree in the present disclosure can be measured by a method regulated in JIS K 2235 5.4.

The penetration value is ten times the length (mm) of the needle that has penetrated vertically. There is no specific limitation to the content of the releasing agent in the toner. For example, the content is preferably from 2% by weight to 15% by weight and more preferably from 4% by weight to 10% by weight.

When the content is too small, the abrasion resistance of the output image is not easily improved. When the content is too large, the hardness, the high temperature stability, and the fluidity of the toner tend to deteriorate.

There is no specific limitation to the coloring agents and any known dyes and pigments can be suitably used. Specific examples thereof include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Faise Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone BlueFast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and the like. These can be used alone or in combination.

There is no specific limitation to the selection of the color of the coloring agent. Pigments for black color and pigments for color can be used. These can be used alone or in combination.

Specific examples of the black pigments include, but are not limited to, carbon black (C.I. Pigment Black 7) such as furnace black, lamp black, acetylene black, and channel black, metals such as copper, iron (C.I. Pigment Black 11), and titanium oxides, and organic pigments such as aniline black (C.I. Pigment Black 1).

Specific examples of the pigments for magenta include, but are not limited to, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; C.I. Vat Red 1, 2, 10, 13, 15, 23, 29, and 35.

Specific examples of the pigments for magenta include, but are not limited to, C.I. Pigment Blue 2, 3, 15, 15:1, 15:2, 15:3, 15:4, 15:6, 16, 17, 60; C.I. Vat Blue 6; C.I. Acid Blue 45; Copper phthalocyanine pigments in which one to five phthal imidemethyl groups are substituted in the phthalocyanine skeleton; and Green 7 and Green 36.

Specific examples of the pigments for yellow include, but are not limited to, C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, 180; C.I. Vat Yellow 1, 3, and 20; and Orange 36.

There is no specific limit to the content of the coloring agent in the toner. The content is preferably from 1% by weight to 15% by weight and more preferably from 3% by weight to 10% by weight.

When the content of the coloring agent is too small, the coloring performance of the toner tends to deteriorate. To the contrary, when the content of the coloring agent is too large, dispersion of the pigment in the toner tends to be poor, thereby degrading the coloring performance and the electric characteristics of the toner.

The coloring agent and the resin can be used in combination as a master batch.

There is no specific limitation to the resin and any known resin can be suitably selected. Specific examples thereof include, but are not limited to, styrene or substituted polymers thereof, styrene-based copolymers, polymethyl methacrylate resins, poly butyl methacrylate resins, polyvinyl chloride resins, polyvinyl acetate resins, polyethylene resins, polypropylene resins, polyesters resins, epoxy resins, epoxy polyol resins, polyurethane resins, polyamide resins, polyvinyl butyral resins, polyacrylic resins, rosin, modified rosins, terpene resins, aliphatic hydrocarbon resins, alicyclic hydrocarbon resins, aromatic petroleum resins, chlorinated paraffin, and paraffin. These can be used alone or in combination.

Specific examples of styrene-based copolymers or substituted polymers of styrene include, but are not limited to, polyester resins, polystyrene resins, poly(p-chlorostyrene) resins, and polyvinyl toluene resins.

Specific examples of the styrene-based copolymers include, but are not limited to, styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers. These master batches may be the crystalline resins of the present disclosure.

The master batch is prepared by mixing and kneading the resin for the master batch resin mentioned above and the coloring agent mentioned above upon application of high shear stress thereto. In this case, an organic solvent can be used to boost the interaction between the coloring agent and the resin.

In addition, so-called flushing methods and a wet cake of the coloring agent can be used as they are, which is advantageous in that there is no need to drying.

The flushing method is a method in which a water paste containing water of a coloring agent is mixed or kneaded with an organic solvent and the coloring agent is transferred to the resin side to remove water and the organic solvent component.

High shearing dispersion devices such as a three-roll mill, etc. can be used for mixing or kneading.

The toner of the present disclosure may contain a charge control agent, an external additive, and other components in addition to the binder resin, the coloring agent, and the releasing agent as long as these do not have an adverse impact on the present disclosure.

There is no specific limitation to the selection of any known charge control agent any known charge control agent can be suitably used. However, colorless or white materials are preferable because color materials may have an impact on the coloring. Specific examples of the charge control agent include, but are not limited to, triphenylmethane dyes, chelate pigments of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and metal salts of salicylic acid derivatives. These can be used alone or in combination.

Charge control agents available in the market can be used.

Specific examples thereof include, but are not limited to, BONTRON P-51 (quaternary ammonium salt), E-82 (metal complex of oxynaphthoic acid), E-84 (metal complex of salicylic acid), and E-89 (phenolic condensation product), which are manufactured by ORIENT CHEMICAL INDUSTRIES CO., LID.; TP-302 and TP-415 (molybdenum complex of quaternary ammonium salt), which are manufactured by HODOGAYA CHEMICAL1 CO., LTD.; COPY CHARGE PSY VP2038 (quaternary ammonium salt), COPY BLUE PR (triphenyl methane derivative), COPY CHARGE NEG VP2036 and NX VP434 (quaternary ammonium salt), which are manufactured by HOECHST AG; LRA-901, and LR-147 (boron complex), which are manufactured by JAPAN CARLIT CO., LTD.; quinacridone, azo pigments and polymers having a functional group such as a sulfonate group, a carboxyl group, and a quaternary ammonium group.

The charge control agent can be dissolved and/or dispersed after it is melted, mixed, and kneaded with the master batch. Alternatively, the charge control agent can be added together with each component of the toner when dissolving and/or dispersing these. Also, the charge control agent can be fixed on the surface of the toner after manufacturing the toner particles.

The content of the charge control agent in the toner depends on the kind of the binder resin, presence of additives, and dispersion method so that it is not simply regulated but, for example, is preferably from 0.1 parts by weight to 10 parts by weight and more preferably from 0.2 part by weight to 5 parts by weight based on 100 parts by weight of the binder resin.

When the content is too low, the charge control property is not easily obtained. When the content is too high, the toner tends to have an excessive chargeability, thereby increasing the force of electrostatic attraction with the development roller and inviting deterioration of the fluidity of the toner and a decrease in the image density.

There is no specific limitation to the external additives and any known external additives can be suitably used.

Specific examples thereof include, but are not limited to, silica particulates, hydrophobic silica, aliphatic acid metal salts (such as zinc stearate and aluminum stearate); metal oxides (such as titania, alumina, tin oxide, and antimony oxide), and fluoropolymers.

Among these, hydrophobized silica particulates, hydrophobized titania particulates, hydrophobized titanium oxide particulates, and hydrophobized alumina particulates are preferable.

Specific examples of the silica particles include, but are not limited to, HDK H 2000, HDK H 2000/4, HDK H 2050 EP, HVK21, HDK H 1303, (all manufactured by HOECHST AG), R972, R974, RX200, RY200, R202, R805, and R812 (manufactured by NIPPON AEROSIL CO., LTD.)

In addition, specific examples of the titania particulates include, but are not limited to, P-25 (manufactured by NIPPON AEROSIL CO., LTD.), STT-30 and STT-65C-S (manufactured by TITAN KOGYO, LTD.), TAF-140 (manufactured by FUJI TITANIUM INDUSTRY CO., LTD.), and MT-150W, MT-500B, MT-600B, and MT-150A (manufactured by TAYCA CORPORATION).

Among these, specific examples of the hydrophobized titan oxide particulates include, but are not limited to, T-805 (manufactured by NIPPON AEROSIL CO., LTD.), STT-30A and STT-65S-S (manufactured by TITAN KOGYO, LTD.), TAF-500T and TAF-1500T (manufactured by FUJI TITANIUM INDUSTRY CO., LTD.), MT-100S and MT-100T (manufactured by TAYCA CORPORATION), and IT-S (manufactured by ISHIHARA SANGYO KAISHA LTD.).

The hydrophobized oxide particulates, the hydrophobized silica particulates, the hydrophobized titania particulates, and the hydrophobized alumina particulates can be obtained by treating hydrophillic particulates with a silane coupling agent such as methyl trimethoxyxilane, methyltriethoxy silane, and octyl trimethoxysilane.

Silicon oil treated oxide particulates and inorganic particulates, which are optionally treated with heated silicone oil, are also preferable.

Specific examples of the silicone oils include, but are not limited to, dimethyl silicone oil, methylphenyl silicone oil, chlorophenyl silicone oil, methylhydrogene silicone oil, alkyl-modified silicone oil, fluorine-modified silicone oil, polyether-modified silicone oil, alcohol-modified silicone oil, amino-modified silicone oil, epoxy-modified silicone oil, epoxy/polyether silicone oil, phenol-modified silicone oil, carboxyl-modified silicone oil, mercapto-modified silicone oil, (meth)acryl-modified silicone oil, and α-methylstyrene-modified silicone oil.

Specific examples of such inorganic particulates include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these, silica and titanium dioxide are particularly preferred.

The content of the external additive is preferably from 0.1% by weight to 5% by weight and more preferably from 0.3% by weight to 3% by weight based on the toner.

The inorganic particulate preferably has an average primary particle diameter of 100 nm or less and more preferably from 3 nm to 70 nm.

When the average primary particle diameter is too small, the inorganic particulates are embedded in the toner, thereby inhibiting the features thereof.

When the average primary particle diameter is too large, the image bearing member is easily damaged non-uniformly.

Inorganic particulates and hydrophobized inorganic particulates can be used in combination as the external additives.

The hydrophobized particulates preferably have an average primary particle diameter of from 1 nm to 100 nm and more preferably contain at least two kinds of inorganic particulates having an average primary particle diameter of from 5 nm to 70 nm.

Furthermore, the external additives preferably contain at least two kinds of inorganic particulates having an average primary particle diameter of 20 nm or less and at least one kind of inorganic particulate having an average primary particle diameter of 30 nm or greater.

In addition, the specific surface area of such inorganic particulates measured by the BET method is preferably from 20 $m^2/g$ to 500 $m^2/g$.

Specific examples of surface treating agents of the external additives containing the oxide particulates include, but are not limited to, silane coupling agents such as dialkyl dihalogenated silane, trialkyl halogenized silane, alkyl trihalogenized silane, and hexa alkyl disilazane; silylating agents, silane coupling agents having an alkyl fluoride group, organic titanate coupling agents, aluminum-containing coupling agents, silicone oil, and silicone varnish.

Resin particulates can be added as the external additives.

Specific examples thereof include, but are not limited to, polystyrene prepared by a soap-free emulsion polymerization method, a suspension polymerization method, or a dispersion polymerization method; and copolymers of methacrylic acid esters and acrylic acid esters; polycondensation resins such as silicone resins, benzoguanamine resins, and nylon resins, and polymerized particles by a thermocuring resin.

By a combinational use with such resin particulates, the chargeability of the toner is improved, thereby reducing the reversely charged toner, resulting in a decrease in background fouling.

The content of the resin particulates is preferably from 0.01% by weight to 5% by weight, and more preferably from 0.1% by weight to 2.0% by weight, based on the toner.

There is no specific limitation to the other components.

Specific examples thereof include, but are not limited to, a fluidity improver, a cleaning property improver, a magnetic material, and metal soap.

The fluidity improver is prepared by surface treatment to improve the hydrophobic property and prevent deterioration of the fluidity and the chargeability even in a high humidity environment.

Specific examples of the fluidity improver include, but are not limited to, silane coupling agents, silylating agents, silane coupling agents including an alkyl fluoride group, organic titanate coupling agents, aluminum containing coupling agents, silicone oil, and modified silicone oil.

The cleaning property improver is added to the toner to remove the development agent remaining on the image bearing member or an intermediate transfer element after transfer of an image. Specific examples thereof include, but are not limited to, zinc stearate, calcium stearate, and aliphatic metal salts of stearic acid, polymer particulates such as polymethyl methacrylate particulates and polystyrene particulates, which are prepared by a soap-free emulsion polymerization method.

The polymer particulates preferably have a relatively narrow particle size distribution and the weight average particle diameter thereof is preferably from 0.01 μm to 1 μm.

There is no specific limitation to the magnetic materials and any known magnetic materials can be suitably used. Specific examples thereof include, but are not limited to iron powder, magnetite, and ferrite. Among these, white materials are preferable in terms of coloring.

There is no specific limitation to any method of manufacturing the toner of the present disclosure and any material thereof that satisfy the conditions. For example, a mixing, kneading, and pulverizing method and a method of granulating toner particles in an aqueous medium, so called chemical manufacturing methods, are suitably used.

The crystalline resin of the present disclosure has an excellent shock resistance.

Therefore, an extremely high energy is required to pulverize the crystalline resin till a particle diameter of 10 μm or less. Therefore, the chemical manufacturing method in which the crystalline resins are easily granulated is preferable.

In addition, since the toner obtained by the mixing and kneading and pulverizing method can be pulverized at the interface of the binder resin and the releasing agent, the releasing agent tends to expose to the surface of the toner, thereby reducing the hardness of the toner and causing filming on carriers and the image bearing member.

On the other hand, the chemical manufacturing method is advantageous to disperse the releasing agent in the toner particles.

Specific examples of the chemical manufacturing method of granulating toner particles in an aqueous medium include, but are not limited to, a suspension polymerization method, emulsification polymerization method, a seed polymerization method, and a dispersion polymerization method that manufacture a toner using a monomer as the initial material, a dissolution suspension method of dissolving a resin precursor and a resin followed by dispersion and/or emulsification in an aqueous medium, a phase change emulsification method of adding water to a solution containing a resin, a resin precursor, and a suitable emulsifier, and an agglomeration method of granulating particles having desired size by agglomerating the resin particles obtained by these methods which are dispersed in the aqueous medium followed by heating, melting, etc.

Among these, the toner obtained by the dissolution suspension method is preferable in light of the granularity (easiness of controlling the particle size distribution, controlling of particle forms, etc.) of the crystalline resin. These methods are described in detail below.

In the mixing, kneading, and pulverizing method, for example, a toner material containing at least a coloring agent, a binder resin, and a releasing agent is melted and mixed and kneaded, and thereafter pulverized and classified to manufacture mother particles of the toner described above.

In the melting, mixing, and kneading, the toner material are mixed and placed in a melting, mixing and kneading machine for melting, mixing, and kneading Single-screw or twin-screw continuous mixing and kneading machines or batch type mixing and kneading machines by a roll mill can be used as the melting and mixing and kneading machine.

Specific examples thereof include, but are not limited to, KTK type twin-screw extruders (manufactured by KOBE STEEL., LTD.), TEM type extruders (manufactured by TOSHIBA MACHINE CO., LTD), twin-screw extruders (manufactured by KCK), PCM type twin-screw extruders (manufactured by Ikegai Corp.), and Ko-kneaders (manufactured by Buss).

This melting and mixing and kneading are required to be conducted under suitable conditions not to sever the molecular chain of the binder resins.

To be specific, the temperature in the melting and mixing and kneading operation is determined referring to the softening point of the binder resin. When the temperature is too high relative to the softening point, the molecular chain tends to be severely severed. When the temperature is too high relative to the softening point, dispersion tends not to proceed smoothly.

In the pulverization process, the mixture obtained in the mixing and kneading is pulverized.

In the pulverization process, it is preferable to coarsely pulverize the mixed and kneaded materials first followed by fine pulverization.

In this process, kneaded mixtures are pulverized by collision with a collision board in a jet stream, collision between particles in a jet stream, and pulverization at narrow gaps between a stator and a rotor that is mechanically rotating, etc.

The classification process adjusts the pulverized material obtained in the pulverization process by classification to have a predetermined particle diameter.

The classification can be performed by removing particulate portions using a cyclone, a decanter, or a centrifugal. After the pulverization and classification, the pulverized material is classified into an air stream by centrifugal, etc. to manufacture mother toner particles having a predetermined particle diameter.

In the chemical manufacturing method, for example, mother particles of the toner of the present disclosure are granulated by dispersing and/or emulsifying particulates containing at least a coloring agent, a binder resin, and a releasing agent in an aqueous medium.

There is no specific limitation to the method of preparing an aqueous liquid dispersion of organic resin particulates from a resin.

For example, the following methods of (a) to (h) can be used.

(a) A method of manufacturing an aqueous liquid dispersion of resin particulate directly from the polymerization reaction by a suspension polymerization method, an emulsification polymerization method, a seed polymerization method, or a dispersion polymerization method from a monomer as the initial material in the case of a vinyl based resin.

(b) A method of manufacturing an aqueous dispersion element of resin particulates by: dispersing a precursor (monomer, oligomer, etc.) or its solvent solution under the presence of a suitable dispersion agent and curing the resultant by heating and/or adding a curing agent in the case of a polyaddition or polycondensation resin such as a polyester resin, a polyurethane resin and an epoxy resin.

(c) A method of phase change emulsification of dissolving a suitable emulsification agent in a precursor (monomer, oligomer, etc.) or its solvent solution (liquid is preferred, solution liquidized by heating is also allowable) followed by adding water for phase change in the case of a polyaddition or polycondensation resin such as a polyester resin, a polyurethane resin and an epoxy resin.

(d) A method of pulverizing a resin preliminarily manufactured by a polymerization reaction (addition polymerization, ring scission polymerization, polyaddition, addition condensation, polycondensation, etc.) with a fine grinding mill of a mechanical rotation type or jet type, classifying the resultant to obtain resin particulates, and dispersing the resin particulates in water under the presence of a suitable dispersion agent.

(e) A method of spraying a resin solution in which a preliminarily manufactured resin by a polymerization reaction (addition polymerization, ring scission polymerization, polyaddition, addition condensation, polycondensation, etc.) is dissolved in a solvent in a form of a fine liquid mist to obtain resin particulates followed by dispersion in water under the presence of a suitable dispersion agent.

(f) A method of adding a solvent to a resin solution in which a preliminarily manufactured resin by a polymerization reaction (addition polymerization, ring scission polymerization, polyaddition, addition condensation, polycondensation, etc.) is dissolved in a solvent or cooling down a resin solution preliminarily prepared by dissolving the resin in a solvent by heating to precipitate resin particulates; removing the solvent to obtain the resin particulates; and dispersing them in water under the presence of a suitable dispersion agent.

(g) A method of dispersing a resin solution in which a preliminarily manufactured resin by a polymerization reaction (addition polymerization, ring scission polymerization, polyaddition, addition condensation, polycondensation, etc.) is dissolved in a solvent in an aqueous medium under the presence of a suitable dispersion agent; and removing the solvent by heating, reducing pressure, etc.

(h) A method of dissolving a suitable emulsifying agent in a resin solution in which a preliminarily manufactured resin by a polymerization reaction (addition polymerization, ring scission polymerization, polyaddition, addition condensation, polycondensation, etc.) is dissolved in a solvent; and adding water to the solution for phase change emulsification.

In addition, it is possible to use a surface active agent and a polymer protection colloid on emulsification and dispersion in an aqueous medium.

Specific examples of the surface active agents include, but are not limited to, anionic dispersion agents, for example, alkylbenzene sulfonic acid salts, α-olefin sulfonic acid salts, and phosphoric acid salts; cationic dispersion agents, for example, amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic dispersion agents, for example, fatty acid amide derivatives, polyhydric alcohol derivatives; and ampholytic dispersion agents, for example, alanine, dodecyldi(aminoethyl) glycin, di(octylaminoethyl)glycin, and N-alkyl-N,N-dimethylammonium betaine.

Dispersion is improved with an extremely small amount of a surface active agent having a fluoroalkyl group.

Preferred specific examples of the anionic surface active agents having a fluoroalkyl group include, but are not limited to, fluoroalkyl carboxylic acids having from 2 to 10 carbon atoms and their metal salts, disodium perfluoro octanesulfonylglutamate, sodium 3-{omega-fluoroalkyl(C6-C11)oxy}-1-alkyl(C3-C4) sulfonate, sodium 3-{omega-fluoroalkanoyl (C6-C8)-N-ethylamino}-1-propanesulfonate, fluoroalkyl (C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl) perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the cationic surface active agents include, but are not limited to, primary, secondary, or tertiary aliphatic amino acids having a fluoroalkyl group, aliphatic quaternary ammonium salts (for example, perfluoroalkyl (C6-C10)sulfoneamidepropyltrimethyl ammonium salts), benzalkonium salts, benzetonium chloride, pyridinium salts, and imidazolinium salts.

Specific examples of such polymeric protection colloids include, but are not limited to, polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or a heterocyclic ring having a nitrogen atom (e.g., vinyl pyridine, vinyl pyrrolidone, vinyl imidazole and ethylene imine). In addition, polymers, for example, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protection colloid.

The toner of the present disclosure is preferably obtained by dissolving or dispersing a toner composition that contains at least a coloring agent, a binder resin and/or a precursor thereof, and a releasing agent in an organic solvent to obtain an oil phase and dispersing and/or emulsifying the oil phase in an aqueous medium to granulate toner particles.

The organic solvent to dissolve or dispersing the toner composition having a binder resin and/or a precursor thereof, a coloring agent, and a releasing agent is preferably volatile with a boiling point lower than 100° C. in order to easily remove the organic solvent later.

Specific examples the organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone and methylisobutyl ketone. These can be used alone or in combination.

Among these, ester based solvents such as methyl acetate and ethyl acetate, aromatic based solvent such as toluene and xylene, and halogenized hydrocarbons such as methylene chloride, 1,2-dichloroethane, chloroform, and carbon tetrachloride are especially preferred.

The oil phase obtained by dissolving or dispersing the toner composition having a binder resin and/or a precursor thereof, a coloring agent, and a releasing agent has a solid portion concentration of from about 40% to about 80%.

A concentration that is too high tends to make dissolution or dispersion difficult and the viscosity becomes high so that handling the solution or the liquid dispersion is difficult. A concentration that is too low results in less production amount of toner.

Toner compositions other than the coloring agent and resins such as the releasing agent and a master batch of the toner compositions are separately dissolved or dispersed in the organic solvent and mixed with the resin solution or liquid dispersion described above.

The aqueous medium is not limited to simple water and mixtures of water with a solvent which can be mixed with water are also suitably used.

Specific examples of such a mixable solvent include, but are not limited to, alcohols (e.g., methanol, isopropanol, and ethylene glycol), dimethylformamide, tetrahydrofuran, cellosolves (e.g., methyl cellosolve), lower ketones (e.g., acetone and methyl ethyl ketone), etc.

The amount of the aqueous medium is normally from 50 parts by weight to 2,000 parts by weight and preferably from 100 parts by weight to 1,000 parts by weight based on 100 parts by weight of the toner composition.

When the amount of the aqueous medium is too small, the dispersion state of the toner composition is degraded so that toner particles having a desired particle diameter are not obtained.

An amount of the aqueous medium that is excessively large is not preferred in terms of economy.

It is possible to preliminarily disperse an inorganic dispersion agent or organic resin particulates in the aqueous medium, which is also preferable to have a sharp particle size distribution and stabilize the dispersion.

Specific examples of the inorganic dispersion agent include, but are not limited to, tricalcium phosphate, calcium carbonate, titanium oxide, colloidal silica, and hydroxyapatite.

There is no specific limit to selection of the resin that forms resin particulates as long as the resin can form a aqueous dispersion element.

Any thermoplastic resins or thermocuring resins can be used. Specific examples thereof include, but are not limited to, vinyl based resins, polyurethane resins, epoxy resins, polyester resins, polyamide resins, polyimide resins, silicon based resins, phenolic resins, melamine resins, urea resins, aniline resins, ionomer resins, and polycarbonate resins. These resins can be used alone or in combination.

Among these, vinyl resins, polyurethane resins, epoxy resins, polyester resins, and their combinational use are preferred in terms that a dispersion element having fine spherical resin particulates is easy to obtain.

There is no particular limitation to the method of the emulsification and dispersion in the aqueous medium. Known facilities employing a low speed shearing method, a high speed shearing method, a friction method, a high pressure jet method, an ultrasonic methods etc., can be used.

Among these, the high speed shearing method is preferable in terms of size reduction of particles.

When a high speed shearing type dispersion machine is used, there is no particular limitation to the rotation speed thereof. The rotation speed is typically from 1,000 rpm to 30,000 rpm, and preferably from 5,000 rpm to 20,000 rpm.

The temperature during the dispersion process is typically from 0° C. to 150° C. (under pressure) and preferably from 20° C. to 80° C.

When the toner composition contains the precursor of the binder resin, it is possible to preliminarily mix a compound having the active hydrogen group mentioned above, etc. required to conduct elongation or cross-linking reaction of the precursor of the binder resin in the oil phase before dispersing the toner composition in the aqueous medium or mix them in the aqueous medium.

Any known method can be used to remove the organic solvent from the obtained emulsified dispersion element.

For example, a method can be employed in which the system is gradually heated under normal pressure or with a reduced pressure to completely evaporate and remove the organic solvent in the droplets.

When an agglomeration method is used in the aqueous medium, it is possible to agglomerate the liquid dispersion and/or liquid emulsification of the toner composition obtained as described above in the aqueous medium for granulation or an emulsified dispersion element obtained by separately dispersing and/or emulsifying toner compositions other than the coloring agent and resins such as the releasing agent and a master batch of the toner compositions in the aqueous medium together for granulation.

These emulsified dispersion element can be added at once or in separate occasions.

To control the agglomeration state, a method of heating, addition of a metal salt, pH adjustment, etc. is preferably used.

There is no specific limitation to the metal salt. Specific examples of the monovalent metal forming the salt include, but are not limited to, sodium and potassium. Specific examples of the divalent metal forming the salt include, but are not limited to, calcium and magnesium. A specific example of the trivalent metal forming the salt is aluminum Specific examples of anions that form the salts include, but are not limited to, chloride ion, bromide ion, iodine ion, carbonate ion, and sulfuric acid ion. Among these, magnesium chloride, aluminum chloride, and complexes and polymers thereof are preferable.

In addition, it is possible to accelerate fusion of resin particles by heating during or after agglomeration, which is preferable in terms of uniformity of the toner.

Furthermore, it is possible to control the form of toner by heating. As the toner is heated, the toner form becomes closer to spherical.

Known technologies are used in the process of washing and drying mother toner particles dispersed in the aqueous medium.

That is, after separation into solid and liquid by a centrifugal or a filter press to obtain a toner cake, the obtained cake is re-dispersed in de-ionized water at room temperature to about 40° C.

Subsequent to optional pH adjustment by an acid or an alkali, the resultant is subject to the solid and liquid separation treatment again. This process is repeated several times to remove impurities and the surface active agent.

Thereafter, the resultant is dried by an air stream drier, a circulation drier, a reduced pressure drier, a vibration flow drier, etc. to obtain toner powder.

Toner particulate components can be removed by a centrifugal and a known classifier can be optionally used after the drying process to obtain a toner having a desired particle size distribution.

The thus prepared toner powder after the drying process can be mixed with other kinds of particles such as the charge control agent particulates and fluidizing agent particulates. Such other kinds of particles can be fixed on and fused to the surface of the toner particles by applying a mechanical impact thereto.

Thus, the other kinds of particles can be prevented from being detached from the surface of the thus obtained complex particles.

Specific examples of such mechanical impact application methods include, but are not limited to, a method in which an impact is applied to a mixture by a blade rotating at a high speed and a method of putting a mixture into a jet air stream to accelerate the speed of (complex) particles to collide each other or with a collision plate.

Specific examples of such mechanical impact applicators include, but are not limited to, ONG MILL (manufactured by HOSOKAWA MICRON CO., LTD.), modified I TYPE MILL (manufactured by Nippon Pneumatic Mfg. Co., Ltd.) in which the air pressure of pulverization is reduced, HYBRIDIZATION SYSTEM (manufactured by NARA MACHINE CO., LTD.), KRYPTRON SYSTEM (manufactured by KAWASAKI HEAVY INDUSTRIES, LTD.), automatic mortars, etc.

The development agent in the present disclosure contains the toner described above and other suitably selected components such as carriers.

The development agent can be a one-component development agent and a two-component development agent and the two-component development agent is preferable in terms of the length of the working life particularly when used in a high speed printer that meets the demand for high speed information processing of late.

When a one-component development agent using the toner described above is used and replenished a number of times, the change in the particle diameter of the toner is small, no filming of the toner on the developing roller occurs, and no fusion bonding of the toner onto members such as a blade for regulating the thickness of the toner layer occurs. Therefore, good and stable developability is sustained to produce quality images even when the development agent is stirred for an extended period of time.

When a two-component development agent using the toner described above is used and replenished a number of times for an extended period of time, the change in the particle diameter of the toner is small.

In addition, good and stable developability is sustained even when the development agent is stirred in a development device for an extended period of time.

There is no specific limitation to the carrier. A carrier is preferable which contains a core material and a resin layer that covers the core material.

There is no specific limitation to the material for the core material and any known material can be suitably used.

For example, manganese-strontium (Mn—Sr) based materials and manganese-magnesium (Mn—Mg) based materials having 50 emu/g to 90 emu/g are preferable.

To secure the image density, highly magnetized materials such as iron powder having 100 emu/g or more and magnetite having 75 emu/g to 125 emu/g are preferable.

In addition, weakly magnetized copper-zinc (Cu—Zn) based materials having 30 emu/g to 80 emu/g are preferable in terms of reducing the impact of the contact between the toner filaments formed on the development roller and the image bearing member, which is advantageous in improvement of the image quality. These can be used alone or in combination.

The core material preferably has a weight average particle diameter D50 of from 10 μm to 200 μm and more preferably from 40 μm to 100 μm.

When the weight average particle diameter D50 is too small, the amount of fine powder tends to increase in the distribution of the carrier particles and the magnetization per particle tends to decrease, which leads to scattering of the carrier particles.

When the weight average particle diameter D50 is too large, the specific surface area tends to decrease, resulting in scattering of toner.

In a full color image in which solid portions occupy a large ratio, reproducibility tends to deteriorate particularly in the solid portions.

There is no specific limitation to the materials for the resin layer mentioned above and any known resin can be suitably used. Specific examples thereof include, but are not limited to, amino-based resins, polyvinyl-based resins, polystyrene-based resins, polycarbonate-based resins, polyethylene resins, polyvinyl fluoride resins, polyvinylidene fluoride resins, polytrifluoroethylene resins, polyhexafluoropropylene resins, copolymers of vinylidenefluoride and acrylic monomer, copolymers of vinylidenefluoride and vinylfluoride, fluoroterpolymers {fluoro tri-(polymer) copolymer} such as terpolymers of tetrafluoroethylene, fluorovinylidene, and monomers including no fluorine atom, and silicone resins. These can be used alone or in combination. Among these, silicone resins are particularly preferred.

There is no specific limitation to the silicone resins and any known silicone resins are suitably used. Specific examples thereof include, but are not limited to, straight silicone resins formed of only organosiloxane bonding; and silicone resins modified by alkyd resins, polyester resins, epoxy resins, acrylic resins, urethane resins, etc.

Products of silicone resins available in the market can be used. Specific examples of the straight silicone resin include, but are not limited to, KR271, KR255, and KR152, manufactured by Shin-Etsu Chemical Co., Ltd.; and SR2400, SR2406, and SR2410, manufactured by DOW CORNING TORAY CO., LTD.

Products of modified silicone resins available in the market can be used.

Specific examples thereof include, but are not limited to, KR206 (alkyd-modified), KR5208 (acrylic-modified), ES1001N (epoxy-modified), and KR305 (urethane-modified) manufactured by Shin-Etsu Chemical Co., Ltd.; and SR2115 (epoxy-modified), and SR2110 (alkyd-modified), manufactured by DOW CORNING TORAY CO., LTD.

It is possible to use a simple silicone resin and also possible to use it with a component that conducts cross-linking reaction, a charge-control component, etc. simultaneously.

The resin layer may contain electroconductive powder such as metal powder, carbon black, titanium oxide, tin oxide, and zinc oxide.

The average particle diameter of such electroconductive powder is preferably not greater than 1 μm.

When the average particle diameter is too large, controlling the electric resistance may become difficult.

The resin layer described above can be formed by, for example, dissolving the silicone resin described above, etc. in a solvent to prepare a liquid application and applying the liquid application to the surface of the core material described above by a known application method followed by drying and baking.

Specific examples of the known application methods include, but are not limited to, a dip coating method, a spray coating method, and a brushing method.

There is no specific limitation to the solvent. Specific examples thereof include, but are not limited to, toluene, xylene, methylethylketone, methylisobutyl ketone, and cellosolve, and butylacetate.

There is no specific limitation to the baking. An external heating system or an internal heating system can be used.

For example, a fixed electric furnace, a fluid electric furnace, a rotary electric furnace, a method of using a burner furnace, and a method of using a microwave can be suitably used.

The content of the carrier in the resin layer is preferably from 0.01% by weight to 5.0% by weight.

A content that is too small tends to make it difficult to form a uniform layer on the surface of the core material. A content that is too large tends to result in an excessively thick layer, thereby causing granulation between carrier particles so that uniform carrier particles are not obtained.

When the development agent described above is a two component development agent, there is no specific limitation to the content of the carrier in the two component development agent.

For example, the content is preferably from 90% by weight to 98% by weight and more preferably from 93% by weight to 97% by weight.

The mixing ratio of the toner to the carrier in the two component development agent is preferably from 1 part by weight to 10.0 parts by weight based on 100 parts by weight of the carrier.

The image forming apparatus of the present disclosure includes at least a latent electrostatic image bearing member (photoreceptor), a charger, an irradiator, a development device, a transfer device, and a fixing device with optional devices such as a cleaner, a discharging device, a recycling device, and a control device.

A combination of the charger and the irradiator is also referred to as a latent electrostatic image forming device.

The development device has a magnetic field generating device fixed inside and may have a development agent bearing member that is rotatable while bearing the two development agent of the present disclosure.

There is no specific limitation to the latent electrostatic image bearing member with regard to the material, form, structure, size, etc. Specific examples of the form include, but are not limited to, a drum form, a sheet form, and an endless belt form.

As for the structure, it may employ a single-layer structure or a laminate structure.

The size can be suitably determined according to the size of the image forming apparatus and specifications.

Specific examples of the materials include, but are not limited to, inorganic compounds such as amorphous silicon, selenium, CdS, and ZnO; and organic compounds such as polysilane and phthalopolymethine.

There is no specific limitation to the charger that can apply a voltage to the surface of the latent electrostatic image bearing member to uniformly charge it. These are generally classified into (1): a contact type charger that charges the latent electrostatic image bearing member by contact; and (2) a non-contact type charger that charges the latent electrostatic image bearing member in a non-contact manner.

Specific examples of the contact-type charger of (1) include, but are not limited to, an electroconductive or semi-electroconductive charging roller, a magnetic brush, a fur brush, a film, and a rubber blade.

Among these, the charging roller possibly reduces the produced amount of ozone in comparison with corona discharging and has an excellent stability during repetitive use of the latent electrostatic image bearing member, which is suitable to prevent the deterioration of the image quality.

Specific examples of the non-contact-type charger of (2) include, but are not limited to, a non-contact type charger, a needle electrode device, and a solid discharging element using corona discharging; and an electroconductive or semi-electroconductive charging roller arranged against the latent electrostatic image bearing member with a minute gap therebetween.

There is no specific limitation to the irradiator that irradiates the surface of the latent electrostatic image bearing member charged by the charger with light according to the image data.

Specific examples of the irradiators include, but are not limited to, a photocopying optical system, a rod lens array system, a laser optical system, a liquid crystal shutter optical system, and a LED optical system.

The rear side irradiation system in which a latent electrostatic image bearing member is irradiated from the rear side thereof can be also employed.

There is no specific limitation to the development device as long as the development device develops latent electrostatic images with the development agent and any known development device can be used. For example, a development device which accommodates and applies the two component development agent to the latent electrostatic image in a contact or non-contact manner is preferably used.

The development device may employ a thy-type development system or a wet-type development system In addition, the development device may be for a single color or multiple-color. For example, it is preferable to use a two-component development device that includes a stirrer to stir and triboelectrically charge the two component development agent, a magnetic field generating device fixed inside, and a development agent bearing member that is rotatable while bearing the two component development agent on its surface.

In the development device, the toner and the carrier are mixed and stirred to triboelectrically charge the toner. The toner is then held on the surface of the rotating magnet roller in a filament manner to form a magnet brush.

Since the magnet roller is provided in the vicinity of the latent electrostatic image bearing member, part of the toner forming the magnet brush formed on the surface of the magnet roller is electrically attracted to the surface of the latent electrostatic image bearing member.

As a result, the latent electrostatic image is developed with the toner and rendered visual as a toner image on the surface of the latent electrostatic image bearing member.

FIG. 1 is a schematic diagram illustrating an example of a two component development device 424 using a two component development agent containing toner and magnetic carrier.

In the two component development agent device of FIG. 1, the two component development agent is stirred and transferred by a screw 441 and supplied to a development sleeve 442 serving as the development agent bearing member.

The two component development agent supplied to the development sleeve 442 is regulated by a doctor blade 443 serving as a layer thickness regulator. The supplying amount of the development agent is controlled by a doctor gap formed between the doctor blade 443 and the development sleeve 442.

When this doctor gap is too small, the amount of development agent tends to be small, resulting in the shortage of the image density. When this doctor gap is too large, the development agent is easily supplied excessively, which causes the carrier to attach to an image bearing drum 1 serving as the latent electrostatic image bearing member.

Therefore, inside the development sleeve 442, a magnet is provided to serve as a magnetic field generating device that forms a magnetic field to hold the development agent on the circumference surface of the development sleeve 442 in a filament manner so that the magnetic filament brush are formed like a chain on the development sleeve 442 following the magnetic line in the normal line direction generated by the magnet.

The development sleeve 442 and the image bearing drum 1 are arranged in the vicinity of each other with a constant gap (development gap) to form development areas on both opposing portions.

The development sleeve 442 has a cylindrical form made of non-magnetic substance such as aluminum, brass, stainless steel, and electroconductive resin and is rotatable by a rotation driving mechanism.

The magnetic brush is transferred to the development area by the rotation of the development sleeve 442.

A development bias is applied to the development sleeve 442 by a power source for development so that the toner on the magnet brush is separated from carrier by the development electric field formed between the development sleeve 442 and the image bearing drum 1 to develop the latent electrostatic image on the image bearing drum 1.

An AC voltage can be superimposed on the development voltage.

The size of the development gap is preferably from about 5 times to about 30 times as large as the particle diameter of the development agent.

If the development agent has a particle diameter of 50 μm, a suitable development gap is from 0.25 mm to 1.5 mm.

When the development gap is too large, a desired image density is not easily obtained.

In addition, the doctor gap is preferably the same as the development gap or slightly larger than that.

The drum diameter of the image bearing drum 1, the drum linear speed thereof, the sleeve diameter of the development sleeve 442, and the sleeve linear speed thereof are determined by limitation with regard to the photocopying speed and the size of the device.

The ratio of the sleeve linear speed to the drum linear speed is preferably 1.1 or greater to obtain a required image density.

It is also possible to provide a sensor at a position on the downstream side of the development that detects the attachment amount of the toner from the optical reflectivity to control the process conditions.

The transfer device is classified into a transfer device that directly transfers the visual image on the latent electrostatic image bearing member to a recording medium and a transfer device that secondarily transfer the visual image to a recording medium after primarily transferring the visual image to an intermediate transfer body.

There is no specific limitation to both transfer devices and any known transfer devices can be suitably selected.

There is no specific limitation to the fixing device. A fixing device having a fixing member and a heating source that heats the fixing member is preferably used.

There is no specific limitation to the fixing device that forms a nip portion with members in contact with each other.

For example, a combination of an endless belt and a roller and a combination of rollers are suitably used.

It is preferable to use the combination of the endless belt and the roller and a method of heating the surface of the fixing member by induction-heating in terms of lessening the warming-up time and saving energy.

The fixing device is classified into (1) a system (interior heating system) in which a fixing device has at least one of a roller and a belt and conducts heating from the side of the surface not in contact with the toner to fix a transfer image transferred onto a recording medium by heat and a pressure; and (2) a system (exterior heating system) in which a fixing device has at least one of a roller and a belt and conducts heating from the side of the surface in contact with the toner to fix a transfer image transferred onto a recording medium by heat and a pressure. It is possible to use both in combination.

As the fixing device of interior heating system of (1), for example, a fixing device itself having a heating device inside thereof can be used.

A heat source such as a heater and a halogen lamp can be used as such a heating system.

As the fixing device of exterior heating system of (2), for example, a system is preferable in which at least part of the surface of at least one of the fixing members is heated by a heating device.

There is no specific limitation to the heating device.

A specific example thereof include, but are not limited to, an electromagnetic induction heating device.

There is no specific limitation to the electromagnetic induction heating device. A system having a device to generate a magnetic field and a device to generate heat by electromagnetic induction is preferable.

As the electromagnetic induction heating device, a device is preferable which has an induction coil arranged close to the fixing member (for example, the heating roller), a shielding layer to which the induction coil is provided, and an insulation layer provided onto the side of the shielding layer which is reverse to the side on which the induction coil is provided.

It is preferable that the heating roller has a system having a magnetic substance or a heating pipe.

It is preferable that the induction coil is arranged on the side of the heating roller while encapsulating at least the semicircle portion and the side is reverse to the contact portion of the heating roller and the fixing member (for example, the pressing roller and the endless belt).

The process cartridge of the present disclosure includes at least a latent electrostatic image bearing member that bears a latent electrostatic image, a development device that develops the latent electrostatic image borne on the latent electrostatic image bearing member with the development agent of the present disclosure to obtain a visual image, and other optional devices such as a charger, an irradiator, a transfer device, a cleaner, and a discharging device.

The development device includes a development agent container to accommodate the development agent, a development agent bearing member to bear and transfer the development agent accommodated in the development agent container, and other optional devices such as a layer thickness regulator to regulate the layer thickness of the development agent borne on the development agent bearing member.

To be specific, any of the development device described in the image forming apparatus can be suitably used.

In addition, as for the charger, the irradiator, the transfer device, the cleaner, and the discharging device, the same devices as described in the image forming apparatus can be suitably used.

The process cartridge described above is detachably attachable to various electrophotographic image forming apparatuses, facsimile machines, and printers and preferably detachably attachable to the image forming apparatus of the present disclosure.

The process cartridge includes, for example, a latent electrostatic image bearing member 101, a charger 102, a development device 104, a transfer device 108, a cleaner 107, and other optional devices.

Figure 2:
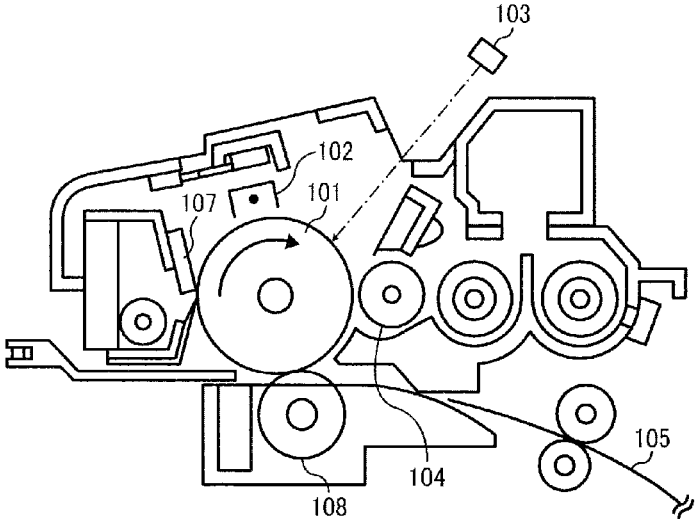
FIG. 2 is a schematic diagram illustrating an example of the process cartridge of the present disclosure.

In FIG. 2, the numeral references 103 and 105 represent beams of light by an irradiator and a recording medium, respectively.

Next, the image forming process by the process cartridge illustrated in FIG. 2 is described.

The latent electrostatic image bearing member 101 is charged by the charging device 102 and irradiated with the beams of light 103 by an irradiator while rotating in the direction indicated by an arrow to form a latent electrostatic image on the surface of the latent electrostatic image bearing member 101 corresponding to the irradiation image.

This latent electrostatic image is developed with toner by the development device 104 and the developed toner image is transferred by the transfer device 108 to the recording medium 105 and printed out.

The surface of the latent electrostatic image bearing member 101 after image transfer is cleaned by the cleaner 107 and discharged by a discharging device to be ready for the next image forming process.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified

EXAMPLES

Next, the present disclosure is described in detail with reference to Examples and Comparative examples but not limited thereto.

Example 1

Manufacturing Example of Crystalline Resin A1

Place 241 parts of sebacic acid, 31 parts of adipic acid, 164 parts of 1,4-butane diol, and 0.75 parts of titanium dihydroxybis (triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 225° C. and distilling away produced water and 1,4-butane diol in a nitrogen atmosphere and continue the reaction with a reduced pressure of 5 mmHg to 20 mmHg until the weight average molecular weight Mw of the resultant reaches about 6,000.

Transfer 218 parts of the thus obtained crystalline resin to a reaction container equipped with a condenser, a stirrer, and a nitrogen introducing tube and add 250 parts of ethyl acetate and 82 parts of hexamethylene diisocyanate (HDI) thereto to conduct reaction at 80° C. in a nitrogen atmosphere for five hours.

Then, distill away ethyl acetate with a reduced pressure to obtain Crystalline Resin A1 (polyester/polyurethane resin) having an Mw of about 22,000 and a maximum peak temperature of melting heat of 60° C.

Manufacturing Example of Non-Crystalline Resin C1

Place 240 parts of 1,2-propane diol, 226 parts of terephthalic acid, and 0.64 parts of tetrabutoxy titanate titanium as a condensing catalyst in a reaction container equipped with a condenser, a stirrer, and a nitrogen introducing tube to conduct reaction at 180° C. in a nitrogen atmosphere for eight hours while distilling away produced methanol.

Next, conduct reaction for four hours while gradually heating the system to 230° C. and distilling away produced water and 1,2-propane diol in a nitrogen atmosphere and continue the reaction for one hour with a reduced pressure of 5 mmHg to 20 mmHg followed by cooling down to 180° C.

hereafter, put 8 parts of trimellitic anhydride and 0.5 parts of tetrabutoxy titanate in the reaction container to conduct reaction for one hour and continue the reaction with a reduced pressure of from 5 mmHg to 20 mmHg until Mw reaches about 7,500 to obtain Non-Crystalline Resin C1 (polyester resin) having a glass transition temperature of 61° C. and a maximum peak temperature of melting heat of 65° C.

Manufacturing Example of Coloring Agent Master Batch P1

Mix 100 part of the Crystalline Resin A1, 100 parts of a cyan pigment (C.I. Pigment blue 15:3), and 30 parts of deionized water followed by mixing and kneading in an open roll type mixing and kneading machine (Kneadex, manufactured by NIPPON COKE & ENGINEERING CO., LTD.).

Start mixing and kneading at 90° C. followed by gradual cooling-down to 50° C. to manufacture Coloring Agent Master Batch P1 having a ratio of the resin and the pigment of 1 to 1.

Manufacturing Example of Liquid Dispersion of Wax W1

Place and sufficiently dissolve 20 parts of Microcrystalline wax (Hi-Mic-1090, manufactured by Nippon Seiro Co., Ltd.) having a maximum endothermic peak temperature Wp (melting point) of melting heat of 69° C., a melting starting temperature Ws of 57° C., and a needle penetration degree of 5 at 25° C. and 80 parts of ethyl acetate in a reaction container equipped with a condenser, a stirrer, and a nitrogen introducing tube by heating to 78° C.

After cooling down the system to 30° C. in one hour while stirring, wet-pulverize the resultant in an Ultra Visco Mill, manufactured by AIMEX CO., LTD.) under the condition of a liquid feeding speed of 1.0 Kg/h, a disk peripheral speed of 10 m/s, 0.5 mm zirconia bead filling amount of 80% by weight, and a number of pass of 6 to obtain Liquid Dispersion of Wax W1.

Manufacturing Example of Toner 1

Place 39 parts of Crystalline Resin A1 and 39 parts of ethyl acetate in a container equipped with a thermometer and a stirrer and dissolve them by heating to the melting point of the resin or higher.

Add 90 parts of 50% by weight ethyl acetate solution of Non-Crystalline Resin C1, 20 parts of Liquid Dispersion of Wax W1, 12 parts of Coloring Agent Master Batch P1, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 1.

Maintain the temperature of Oil Phase 1 in the container to be 50° C. and use it within five hours of manufacturing before it is crystallized.

Next, place 90 parts of deionized water, 3 parts of 5% by weight aqueous solution of polyoxyethylene lauryl ether type nonion surface active agent (NL450, manufactured by DAI-ICHI KOGYO SEIYAKU CO., LTD.), 10 parts of ethyl acetate in a container equipped with a stirrer and a thermometer and mix and stir them at 40° C. to prepare an aqueous phase solution. Add 50 parts of Oil Phase 1 maintained at 50° C. to the container and mix them for one minute at 40° C. to 50° C. by a TK type HOMOMIXER (manufactured by PRIMIX Corporation) at a rotation number of 13,000 rpm to obtain Emulsified Slurry 1

Put Emulsified Slurry 1 in a container equipped with a stirrer and a thermometer followed by removing the solvent at 60° C. for six hours to obtain Slurry 1.

Filtrate 100 parts of the obtained Slurry 1 of mother toner particles with a reduced pressure followed by the following washing treatment:

(1): Add 100 parts of deionized water to the filtered cake and mix the mixture by a TK HOMOMIXER at 6,000 rpm for five minutes followed by filtration;

(2): Add 100 parts of 10% sodium hydroxide to the filtered cake obtained in (1) and mix the resultant by a TK HOMOMIXER at 6,000 rpm for ten minutes followed by filtration with a reduced pressure;

(3): Add 100 parts of 10% by weight hydrochloric acid to the filtered cake obtained in (2) and mix the resultant by a TK HOMOMIXER at 6,000 rpm for five minutes followed by filtration;

(4): Add 300 parts of deionized water to the filtered cake obtained in (3) and mix the resultant by a TK HOMOMIXER at a rotation number of 6,000 rpm for five minutes followed by filtration twice to obtain Filtered Cake 1.

Dry the Filtered Cake 1 by a circulation drier at 45° C. for 48 hours.

Screen the dried resultant by a mesh having an opening of 75 μm to obtain Mother Toner Particle 1.

Mix 1.0 part of hydrophobic silica (HDK-2000, manufactured by Wacker Chemie AG) with 100 parts of the thus-obtained Mother Toner Particle 1 by a HENSCHEL MIXER to prepare Toner 1 having a volume average particle diameter of 5.6 μm.

Evaluate the thus obtained Toner 1 and the results are shown in Table 4.

Manufacturing Example of Carrier

The carrier for use in the two-component development agent of the present disclosure is manufactured as follows:

Prepare a liquid application by dispersing 450 parts of toluene, 450 parts of silicone resin (SR2400, non-volatile component: 50%, manufactured by DOW CORNING TORAY CO., LTD.), 10 parts of aminosilane (SH6020, manufactured by DOW CORNING TORAY CO., LTD.), and 10 parts of carbon black as coating material with a stirrer for ten minutes.

Place 5,000 parts of Mn ferrite particles (weight average particle diameter: 35 μm) as core material and the coating liquid in a coating device that conducts coating while forming a swirl flow by a rotatable base plate disk and a stirring wing in the flowing floor to apply the liquid application to the core material.

Bake the thus-obtained coated material in an electric furnace at 250° C. for two hours to obtain Carrier A.

Manufacturing Example of Two Component Development Agent

Uniformly mix 7 parts of the toner manufactured as described above with 100 parts of Carrier A by using a turbuler mixer (manufactured by Willy A. Bachofen (WAB) AG) which tumbles the container for stirring at 48 rpm for three minutes to charge them.

In the present disclosure, place and mix 200 g of Carrier A and 14 g of toner in a stainless container having a volume of 50 ml inside.

Fill with the thus-manufactured two component agent a cyan development unit of a tandem type image forming apparatus (image forming apparatus A) employing an indirect transfer system in which a contact charging system, a two-component development system, a secondary transfer system, a blade cleaning system, and a roller fixing system employing an external heating system; and form images followed by the performance evaluation of the toner and the development agent.

The image forming apparatus A for use in the performance test in the present disclosure is described in detail.

Figure 3:
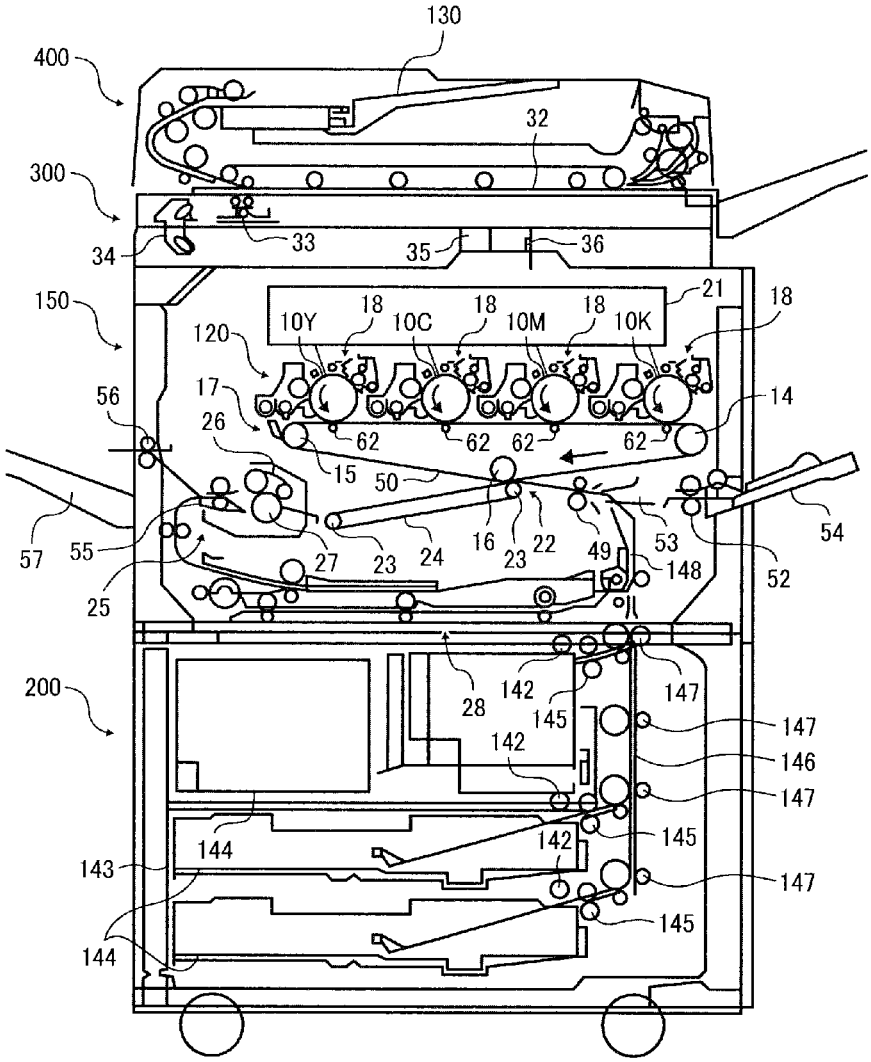
FIG. 3 is a schematic diagram illustrating an example of an image forming apparatus employing a tandem system of the present disclosure.

An image forming apparatus 100 illustrated in FIG. 3 is a tandem type color image forming apparatus.

A tandem development device 120 includes a main portion 150 of the image forming apparatus, a sheet feeder table 200, a scanner 300, and an automatic document feeder (ADF) 400.

The main portion 150 of the image forming apparatus has an intermediate transfer body 50 having an endless form at the center thereof.

The intermediate transfer 50 is suspended over a support rollers 14, 15 and 16 and rotatable clockwise in FIG. 3.

An intermediate transfer body cleaner 17 to remove the un-transferred residual toner remaining on the intermediate transfer body 50 is arranged around the support roller 15.

The tandem development device 120, which has four image forming units 18 of yellow, cyan, magenta and black, is arranged facing the intermediate transfer body 50 suspended over the support rollers 14 and 15 along the transfer direction thereof.

An irradiator 21 is arranged near the tandem development device 120.

A secondary transfer device 22 is arranged facing the tandem development device 120 with the intermediate transfer body 50 therebetween.

In the secondary transfer device 22, a secondary transfer belt 24 having an endless form is suspended over a pair of rollers 23 and a recording medium transferred on the secondary transfer belt 24 is contactable with the intermediate transfer body 50 with each other.

A fixing device 25 is arranged near the secondary transfer device 22.

In addition, in the tandem image forming apparatus 100, a sheet reverse device 28 to form images on both sides of the recording medium by reversing the recording medium is arranged near the secondary transfer device 22 and a fixing device 25.

Next, the formation of a full color image using the tandem development device 120 is described.

First, set a document (original) on a document table 130 on the automatic document feeder 400 or open the automatic document feeder 400, set a document on a contact glass 32 for the scanner 300, and close the automatic document feeder 400.

After the document is moved to the contact glass 32 by pressing a start button in a case in which the document is set on the automatic document feeder 400, or immediately in a case in which the document is set on the contact glass 32, the scanner is driven to start scanning with a first scanning unit 33 and a second scanning unit 34.

Then, the document is irradiated with light emitted from a light source by the first scanning unit 33 and the reflection light from the document is redirected at the mirror of the second scanning unit 34. The redirected light at the mirror of the second scanning unit 34 passes through an image focusing lens 35 and is received at a reading sensor 36 to read the document (color image), thereby obtaining black, yellow, magenta and cyan image data.

Each image data for black, yellow, magenta, and cyan are transmitted to each image forming unit 18 (image forming units for black, yellow, magenta, and cyan) in the tandem development device 120 to form each color toner image of black, yellow, magenta, and cyan at each image forming unit.

Figure 4:
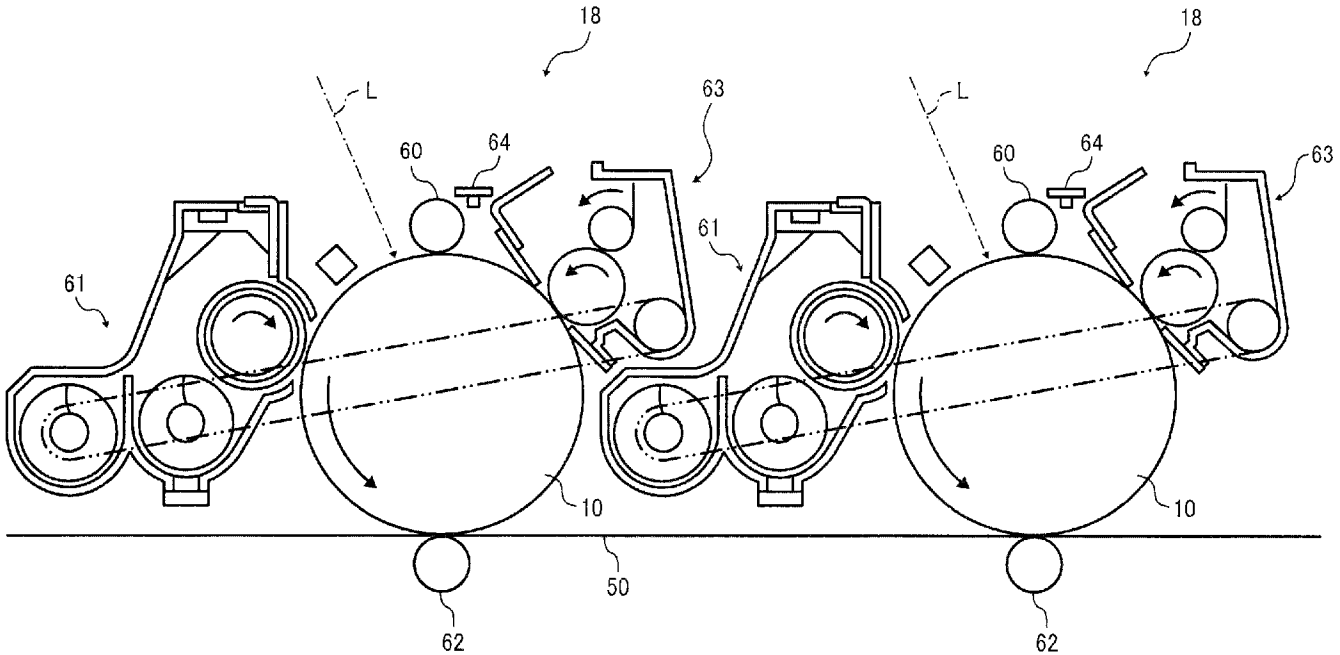
FIG. 4 is an enlarged diagram illustrating each image forming element illustrated in FIG. 3.

As illustrated in FIG. 4, each image forming unit 18 (image forming units for black, yellow, magenta and cyan) in the tandem development device 120 includes a latent electrostatic image bearing member 10 (a latent electrostatic image bearing member 10K for black, a latent electrostatic image bearing member 10Y for yellow, a latent image bearing member 10M for magenta, and a latent electrostatic image bearing member 10C for cyan), a charger 60 that uniformly charges the latent electrostatic image bearing member 10, an irradiator that irradiates the latent electrostatic image bearing member 10 with beams of light L according to each color image data to form a latent electrostatic image corresponding to each color image on the latent electrostatic image bearing member 10, a development unit 61 that forms a toner image with each color toner by developing each latent electrostatic image with each color toner (black toner, yellow toner, magenta toner, and cyan toner), a transfer charger 62 that transfers the toner image to the intermediate transfer body 50, a cleaner 63, and a discharging device 64. Therefore, each single color image (black image, yellow image, magenta image, and cyan image) can be formed based on each color image data.

The black image, the yellow image, the magenta image, and the cyan image formed on the latent image bearing member 10K for black, the latent image bearing member 10Y for yellow, the latent image bearing member 10M for magenta, and the latent image bearing member 10C for cyan, respectively, are primarily transferred sequentially to the intermediate transfer body 50 rotated by the support rollers 14, 15, and 16.

Then, the black image, the yellow image, the magenta image, and the cyan image are superimposed on the intermediate transfer body 50 to form a synthesized color image (color transfer image).

In the sheet feeder table 200, one of the sheet feeder rollers 142 is selectively rotated to bring up recording media (sheets) from one of multiple sheet cassettes 144 stacked in a sheet bank 143. A separating roller 145 separates the recording media one by one to feed it to a sheet path 146. Transfer rollers 147 transfer and guide the recording medium to a sheet path 148 in the main portion 150 of the image forming apparatus 100 and the recording medium is held at a registration roller 49.

Alternatively, the recording media (sheets) on a manual tray 54 are bought up by rotating a roller, and separated one by one by a separating roller 52, transferred to a manual sheet path 53, and also halted at the registration roller 49.

The registration roller 49 is typically grounded but a bias can be applied thereto to remove paper dust on the recording medium.

The registration roller 49 is rotated in synchronization with the synthesized color image (color transfer image) on the intermediate transfer body 50 to send the recording medium (sheet) between the intermediate transfer body 50 and the secondary transfer device 22. The synthesized color image (color transfer image) is secondarily transferred to the recording medium to form a synthesized color image thereon.

The residual toner remaining on the intermediate transfer body 50 after the image transfer is removed by the intermediate transfer body cleaner 17.

The recording medium to which the color image is transferred is sent to the fixing device 25 by the secondary transfer device 22 and the synthesized color image (color transfer image) is fixed on the recording medium by heat and pressure at the fixing device 25. The reference numerals 26 and 27 represent a fixing belt and a pressing roller, respectively.

Thereafter, the recording medium is switched at a switching claw 55, discharged outside by a discharging roller 56, and stacked on a discharging tray 57.

Alternatively, the recording medium is switched by the switching claw 55 and guided to the transfer position again by the sheet reverse device 28 to record another image on the reverse side of the recording medium. Thereafter, the recording medium is discharged by the discharging roller 56 and stacked on the discharging tray 57.

The performance evaluation method of the toner and the development agent for use in the present disclosure is described in detail.

Low Temperature Fixing Property (Lowest Fixing Temperature)

Form a single color solid image (image size: 3 cm×8 cm) of cyan having a toner attachment amount of from 0.75 mg/cm2 to 0.95 mg/cm2 after image transfer on a transfer sheet (photocopying paper <70>, manufactured by NBS RICOH CO., LTD.) using the image forming apparatus A and conduct fixing while changing the temperature of the fixing belt Draw a picture on the surface of the obtained fixed image with a drawing tester (AD-401, manufactured by UESHIMA SEISAKUSHO CO., LTD.) with a ruby needle having a tip diameter of from 260 μmR to 320 μmR with a tip angle of 60 degrees? under a load of 50 g and rub the surface of the drawn picture with a fiber (HONECOTTO #440, manufactured by SAKATA INX ENG CO., LID.) five times. The temperature of the fixing belt at which almost no image scraping occurs is determined as the lowest fixing temperature.

In addition, form the solid image at a position 3.0 cm from the leading end of the transfer sheet relative to the transfer direction.

The speed of the transfer sheet passing through the nipping portion of the fixing device is 280 mm/s.

The lower the lowest fixing temperature is, the better the low temperature fixing property is.

The results are shown in Table 3.

Hot Offset Resistance (Fixable Temperature Range)

Form a single color solid image (image size: 3 cm×8 cm) of cyan having a toner attachment amount of from 0.75 mg/cm2 to 0.95 mg/cm2 after image transfer on a transfer sheet (TYPE 6200, manufactured by RICOH CO., LTD.) using the image forming apparatus A and conduct fixing while changing the temperature of the fixing belt.

Evaluate the fixed image by observation with eyes about hot offset and determine the temperature range between the upper limit temperature above which hot offset occurs and the lowest fixing temperature as the fixable temperature range.

In addition, form the solid image at a position 3.0 cm from the leading end of the transfer sheet relative to the transfer direction.

The speed of the transfer sheet passing through the nipping portion of the fixing device is 280 mm/s.

The wider the fixable temperature range is, the better the hot offset resistance is.

The average temperature range of typical full color toner is about 50° C.

The results are shown in Table 3.

Abrasion Resistance

Form a single color solid image (image size: 3 cm×8 cm) of cyan having a toner attachment amount of from 0.75 mg/cm2 to 0.95 mg/cm2 after image transfer on an entire transfer sheet (photocopying paper <70>, manufactured by NBS RICOH CO., LID.) using the image forming apparatus A and conduct fixing at the temperature 20° C. higher than the lowest fixing temperature of the toner. Rub the surface of the output image by an S-type rubbing tester (SUTHERLAND 2000 RUBTESTER, manufactured by Danilee Co.) using recycled paper (Recycled Paper Resource Type A, manufactured by NBS RICOH CO., Ltd.) under a weight of 800 g 50 times and evaluate the level of the rubbing damage on the surface of the image by comparison with the sample.

Scale the image from 1.0 to 5.0 with an interval of 0.5. A level closer to 5 is better. The level of 4.0 or higher is on par with the typical output level.

The speed of the transfer sheet passing through the nipping portion of the fixing device is 280 mm/s, which is conducted for A4 size in the landscape direction.

Evaluation Criteria 5.0: Slight gloss change observed but almost no rubbing damage observed with naked eyes.

4.0: Gloss change observed with slight rubbing damage 3.0: Significant gloss change observed with apparent rubbing damage 2.0: Apparent rubbing damage and background transfer sheet slightly seen 1.0: Most image scraped and background transfer sheet seen High Temperature Stability (Storage)

Fill a glass container with the toner and leave it in a constant bath at 50° C. for 24 hours. Subsequent to cooling-down to 24° C., measure the needle penetration level of the toner by a needle penetration test (according to JIS K2235-1991) to evaluate the high temperature storage by the following criteria:

A large needle penetration value represents excellent high temperature storage.

Toner having a needle penetration level less than 150 is likely to cause a problem.

Evaluation Criteria

E (Excellent): Needle penetration level is 250 or higher

G (Good): Needle penetration level is from 200 to less than 250

F (Fair): Needle penetration level is from 150 to less than 200

B (Bad): Needle penetration level is from 100 to less than 150

VB (Very Bad): Needle penetration level is less than 100

Example 2

Manufacturing Example of Toner 2

Place 84 parts of Crystalline Resin A1 and 84 parts of ethyl acetate in a container equipped with a thermometer and a stirrer and dissolve them by heating to the melting point of the resin or higher. Add 20 parts of Liquid Dispersion of Wax W1, 12 parts of Coloring Agent Master Batch P1, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 2.

Toner 2 having a volume average particle diameter of 5.6 μm is manufactured in the same manner as in Example 1 except that Oil Phase 2 is used instead of Oil Phase 1 to evaluate the performance of the toner and the development agent.

Example 3

Manufacturing Example of Crystalline Resin A2

Place 283 parts of sebacic acid, 215 parts of 1,6-hexane diol, and 1 part of titanium dihydoroxybis (triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until Mw reaches about 6,000.

Transfer 249 parts by weight of the thus obtained crystalline resin to a reaction container equipped with a condenser, a stirrer, and a nitrogen introducing tube and add 250 parts of ethyl acetate and 82 parts of hexamethylene diisocyanate (MI) thereto to conduct reaction at 80° C. in a nitrogen atmosphere for five hours.

Then, distill away ethyl acetate with a reduced pressure to obtain Crystalline Resin A2 (polyester/polyurethane resin) having an Mw of about 20,000 and a maximum peak temperature of melting heat of 65° C.

Manufacturing Example of Coloring Agent Master Batch P2

Manufacture Coloring Agent Master Batch P2 in the same manner as in Coloring Agent Master Batch P2 of Example 1 except that Crystalline Resin A2 is used instead of Crystalline Resin A1.

Manufacturing Example of Toner 3

Place 39 parts of Crystalline Resin A2 and 39 parts of ethyl acetate in a container equipped with a thermometer and a stirrer and dissolve them by heating to the melting point of the resin or higher.

Add 90 parts of 50% by weight ethyl acetate solution of Non-Crystalline Resin C1, 20 parts of Liquid Dispersion of Wax W1, 12 parts of Coloring Agent Master Batch P2, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 3.

Manufacture Toner 3 having a volume average particle diameter of 5.5 μm in the same manner as in Example 1 except that Oil Phase 3 is used instead of Oil Phase 1 to evaluate the performance of the toner and the development agent.

Example 4

Manufacturing Example of Crystalline Resin A3

Place 322 parts of dodecanedioic acid, 215 parts of 1,6-hexane diol, and 1 part of titanium dihydroxybis (triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until Mw reaches about 6,000.

Transfer 269 parts of the thus-obtained crystalline resin to a reaction container equipped with a condenser, a stirrer, and a nitrogen introducing tube and add 280 parts of ethyl acetate and 85 parts of trilene diisocyanate (TDI) thereto to conduct reaction at 80° C. in a nitrogen atmosphere for five hours.

Then, distill away ethyl acetate with a reduced pressure to obtain Crystalline Resin A3 (polyester/polyurethane resin) having an Mw of about 18,000 and a maximum peak temperature of melting heat of 68° C.

Manufacturing Example of Coloring Agent Master Batch P3

Manufacture Coloring Agent Master Batch P3 in the same manner as in Coloring Agent Master Batch P1 of Example 1 except that Crystalline Resin A3 is used instead of Crystalline Resin A1.

Manufacturing Example of Toner 4

Place 39 parts of Crystalline Resin A3 and 39 parts of ethyl acetate in a container equipped with a thermometer and a stirrer and dissolve them by heating to the melting point of the resin or higher. Add 90 parts of 50% ethyl acetate solution by weight of Non-Crystalline Resin C1, 20 parts of Liquid Dispersion of Wax W1, 12 parts of Coloring Agent Master Batch P3, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 4.

Manufacture Toner 4 having a volume average particle diameter of 5.6 urn in the same manner as in Example 1 except that Oil Phase 4 is used instead of Oil Phase 1 to evaluate the performance of the toner and the development agent.

Example 5

Manufacturing Example of Crystalline Resin A4

Place 142 parts of sebacic acid, 136 parts of dimethyl terephthalic acid, 215 parts of 1,6-hexane diol, and 1 part of titanium dihydroxybis (triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until Mw reaches about 6,000.

Transfer 247 parts of the thus obtained crystalline resin to a reaction container equipped with a condenser, a stirrer, and a nitrogen introducing tube and add 270 parts of ethyl acetate and 123 parts of 4,4'-diphenyl methane diisocyanate (MDI) thereto to conduct reaction at 80° C. in a nitrogen atmosphere for five hours.

Then, distill away ethyl acetate with a reduced pressure to obtain Crystalline Resin A4 (polyester/polyurethane resin) having an Mw of about 11,000 and a maximum peak temperature of melting heat of 52° C.

Manufacturing Example of Coloring Agent Master Batch P4

Manufacture Coloring Agent Master Batch P4 in the same manner as in Coloring Agent Master Batch P1 of Example 1 except that Crystalline Resin A4 is used instead of Crystalline Resin A1.

Manufacturing Example of Toner 5

Place 39 parts of Crystalline Resin A4 and 39 parts of ethyl acetate in a container equipped with a thermometer and a stirrer and dissolve them by heating to the melting point of the resin or higher. Add 90 parts of 50% by weight ethyl acetate solution of Non-Crystalline Resin C1, 20 parts of Liquid Dispersion of Wax W1, 12 parts of Coloring Agent Master Batch P4, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 5.

Manufacture Toner 5 having a volume average particle diameter of 5.6 μm in the same manner as in Example 1 except that Oil Phase 5 is used instead of Oil Phase 1 to evaluate the performance of the toner and the development agent.

Example 6

Manufacturing Example of Non-Crystalline Resin C2

Place 215 parts of an adduct of bisphenol A with 2 mols of propylene oxide, 132 parts of an adduct of bisphenol A with 2 mols of ethylene oxide, 126 parts of terephthalic acid, and 1.8 parts of tetrabuthoxide titanate as a condensing catalyst in a reaction container equipped with a condenser, a stirrer, and a nitrogen introducing tube to conduct reaction for six hours at 230° C. in a nitrogen atmosphere while distilling away produced water.

Next, conduct reaction for one hour with a reduced pressure of from 5 mmHg to 20 mmHg.

Subsequent to cooling down to 180° C., put 8 parts of trimellitic anhydride and continue the reaction with a reduced pressure of from 5 mmHg to 20 mmHg until Mw reaches about 10,000 to obtain Non-Crystalline Resin C2 (polyester resin) having a glass transition temperature of 60° C. and a maximum peak temperature of melting heat of 68° C.

Manufacturing Example of Toner 6

Place 39 parts of Crystalline Resin A1 and 39 parts of ethyl acetate in a container equipped with a thermometer and a stirrer and dissolve them by heating to the melting point of the resin or higher.

Add 90 parts of 50% by weight ethyl acetate solution of Non-Crystalline Resin C2, 20 parts of Liquid Dispersion of Wax W1, 12 parts of Coloring Agent Master Batch P1, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 6.

Manufacture Toner 6 having a volume average particle diameter of 5.7 μm in the same manner as in Example 1 except that Oil Phase 6 is used instead of Oil Phase 1 to evaluate the performance of the toner and the development agent Example 7

Manufacturing Example of Crystalline Resin A5

Place 126 parts of 1,4-butane diol, 215 parts of 1,6-hexane diol, and 100 parts of methylethylketone (MEK) in a reaction container equipped with a condenser, a stirrer, and a nitrogen introducing tube followed by stirring and add 341 parts of hexamethylene diisocyanate (HDI) thereto to conduct reaction at 80° C. in a nitrogen atmosphere for eight hours.

Then, distill away methylethyl ketone to obtain Crystalline Resin A5 (polyurethane resin) having an Mw of about 18,000 and a maximum peak temperature of melting heat of 59° C.

Manufacturing Example of Coloring Agent Master Batch P5

Manufacture Coloring Agent Master Batch P5 in the same manner as in Coloring Agent Master Batch P1 of Example 1 except that Crystalline Resin A5 is used instead of Crystalline Resin A1.

Manufacturing Example of Toner 7

Place 39 parts of Crystalline Resin A5 and 39 parts of ethyl acetate in a container equipped with a thermometer and a stirrer and dissolve them by heating to the melting point of the resin or higher.

Add 90 parts of 50% by weight ethyl acetate solution of Non-Crystalline Resin C1, 20 parts of Liquid Dispersion of Wax W1, 12 parts of Coloring Agent Master Batch P5, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 7.

Manufacture Toner 7 having a volume average particle diameter of 5.6 μm in the same manner as in Example 1 except that Oil Phase 7 is used instead of Oil Phase 1 to evaluate the performance of the toner and the development agent.

Example 8

Manufacturing Example of Toner 8

Place 53 parts of Crystalline Resin A2 and 53 parts of ethyl acetate in a container equipped with a thermometer and a stirrer and dissolve them by heating to the melting point of the resin or higher.

Add 62 parts of 50% by weight ethyl acetate solution of Non-Crystalline Resin C1, 20 parts of Liquid Dispersion of Wax W1, 12 parts of Coloring Agent Master Batch P2, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 8.

Manufacture Toner 8 having a volume average particle diameter of 5.6 μm in the same manner as in Example 1 except that Oil Phase 8 is used instead of Oil Phase 1 to evaluate the performance of the toner and the development agent.

Example 9

Manufacturing Example of Toner 9

Place 66 parts of Crystalline Resin A2 and 66 parts of ethyl acetate in a container equipped with a thermometer and a stirrer and dissolve them by heating to the melting point of the resin or higher.

Add 36 parts of 50% by weight ethyl acetate solution of Non-Crystalline Resin C1, 20 parts of Liquid Dispersion of Wax W1, 12 parts of Coloring Agent Master Batch P2, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 9.

Manufacture Toner 9 having a volume average particle diameter of 5.5 μm in the same manner as in Example 1 except that Oil Phase 9 is used instead of Oil Phase 1 to evaluate the performance of the toner and the development agent.

Example 10

Manufacturing Example of Toner 10

Place 84 parts of Crystalline Resin A2 and 84 parts of ethyl acetate in a container equipped with a thermometer and a stirrer and dissolve them by heating to the melting point of the resin or higher.

Add 20 parts of Liquid Dispersion of Wax W1, 12 parts of Coloring Agent Master Batch P2, and 50 parts of ethyl acetate to the container followed by stiffing by a TK type HOMOMIXER (manufactured by PRIMIX Corporation) at a rotation number of 10,000 rpm at 50° C. for uniform dissolution and dispersion to obtain Oil Phase 10.

Manufacture Toner 10 having a volume average particle diameter of 5.6 μm in the same manner as in Example 1 except that Oil Phase 10 is used instead of Oil Phase 1 to evaluate the performance of the toner and the development agent.

Example 11

Manufacturing Example of Crystalline Resin B2

Place 247 parts of hexamethylene diamine (HDI) and 247 parts of ethyl acetate in a reaction container equipped with a condenser, a stirrer, and a nitrogen introducing tube and add a resin solution in which 249 parts of Crystalline Resin A2 is dissolved in 249 parts of ethyl acetate thereto to conduct reaction at 80° C. for five hours in a nitrogen atmosphere to obtain 50% by weight of ethyl acetate solution of Crystalline Resins Precursor B2 having an isocyanate group at an end.

Manufacturing Example of Toner 11

Place 39 parts of Crystalline Resin A2 and 39 parts of ethyl acetate in a container equipped with a thermometer and a stirrer and dissolve them by heating to the melting point of the resin or higher. Add 20 parts of Liquid Dispersion of Wax W1, 12 parts of Coloring Agent Master Batch P2, and 50 parts of ethyl acetate to the container followed by stirring by a TK type HOMOMIXER (manufactured by PRIMIX Corporation) at a rotation number of 10,000 rpm at 50° C.

Add 90 parts of 50% by weight ethyl acetate solution of Crystalline Resin Precursor B2 to the container followed by a TK type HOMOMIXER (manufactured by PRIMIX Corporation) at a rotation number of 10,000 rpm for uniform dissolution and dispersion to obtain Oil Phase 11.

Maintain the temperature of Oil Phase 11 in the container to be 50° C. and use it within five hours of manufacturing before it is crystallized.

Next, place 90 parts of deionized water, 3 parts of 25% by weight liquid dispersion of organic resin particulates (copolymer of styrene, methacrylic acid, butyl acrylate, and a sodium salt of an adduct of sulfuric ester with ethylene oxide methacrylate, manufactured by SANYO CHEMICALS INDUSTRIES, LTD.) for stabilizing dispersion, 1 part of carboxy methyl cellulose sodium, 16 parts of 48.3% by weight aqueous solution of dodecyl diphenyl ether sodium disulfonate (EREMINOR MON-7, manufactured by SANYO CHEMICALS INDUSTRIES, LTD.), and 5 parts of ethylacetate in a container equipped with a stirrer and a thermometer and mix and stir them at 40° C. to prepare a water phase solution. Add 80 parts of Oil Phase 11 maintained at 50° C. and 7 parts of isophorone diamine to the water phase solution followed by mixing for one minute at 40° C. to 50° C. by a TK type HOMOMIXER (manufactured by PRIMIX Corporation) at a rotation number of 11,000 rpm to obtain Emulsified Slurry 11.

Then, place Emulsified Slurry 11 in a reaction container equipped with a stirrer and a thermometer followed by removal of the solvent at 60° C. for six hours. Subsequent to a ten hour aging (reaction) of non-reacted crystalline resin precursor at 45° C., Slurry 11 is obtained.

Manufacture Toner 11 having a volume average particle diameter of 5.6 μm in the same manner as in Example 1 except that Slurry 11 is used instead of Slurry 1 to evaluate the performance of the toner and the development agent.

Example 12

Manufacturing Example of Toner 12

Preliminarily mix 39 parts of Crystalline Resin A1, 45 parts of Non-Crystalline Resin C1, 4 parts of microcrystalline wax (HI-Mic-1090, manufactured by NIPPON SEIRO CO., LTD.) having a maximum endotherm peak temperature Wp (melting point) of melting heat of 69° C., a melting starting temperature Ws of 57° C., and a needle penetration degree of 5 at 25° C., and 12 parts of Coloring Agent Master Batch P1 by a HENSCHEL MIXER (FM10B, manufactured by NIPPON COKE & ENGINEERING CO., LTD.) followed by melting and mixing and kneading by a double wheels mixer (PCM-30, manufactured by IKEGAI CORPORATION) at 80° C. to 120° C.

Cool down the obtained mixture to room temperature followed by coarse-pulverization by a hammer mill to 200 μm to 300 μm.

Finely-pulverize the resultant by a supersonic jet mill (Labojet, manufactured by NIPPON PNEUMATIC MFG. Co., LTD.) in order to obtain a weight average particle diameter of from 5.2 μm to 5.8 μm while adjusting the pulverization air pressure and classify the resultant by an air current classifier (MDS-1, manufactured by NIPPON PNEUMATIC MFG. Co., LID.) in order that the weight average particle diameter is from 5.9 μm to 6.3 μm and the amount of fine powder having a weight average particle diameter of 4 μm or less is 10% by number or less while adjusting the louver opening to obtain Mother Toner Particle 12.

Manufacture Toner 12 having a volume average particle diameter of 6.1 μm in the same manner as in Example 1 except that Mother Toner Particle 12 is used instead of Mother Toner Particle 1 to evaluate the performance of the toner and the development agent.

Example 13

Manufacturing Example of Toner 13

Add 100 parts of Oil Phase 1 to an aqueous phase in which 100 parts of water, 5 parts of 48.3% by weight aqueous solution of dodecyl diphenyl ether sodium disulfonate (EREMINOR MON-7, manufactured by SANYO CHEMICALS INDUSTRIES, LTD.), 2 parts of 2% by weight sodium hydroxide aqueous solution and emulsify the resultant with a HOMOGENIZER (ULTRA-TURRAX® T50, manufactured by IKA GmbH & Co. KG) followed by emulsification by MANTON GAULIN high pressure HOMOGENIZER (manufactured by GAULIN CO.,) to obtain Emulsified Slurry 13.

Put Emulsified Slurry 13 in a container equipped with a stirrer and a thermometer followed by removing the solvent at 60° C. for four hours to obtain a slurry.

The volume average particle diameter of the obtained slurry is measured by a particle size distribution analyzer (LA-920, manufactured by HORIBA LTD.) and found to be 0.15 μm.

Place 1,000 parts of water, 5 parts of 48.3% by weight aqueous solution of dodecyl diphenyl ether sodium disulfonate (EREMINOR MON-7, manufactured by SANYO CHEMICALS INDUSTRIES, LTD.), and 800 parts of the slurry in a container equipped with a stirrer and a thermometer, adjust pH thereof to be 10 by 2% by weight sodium hydroxide aqueous solution, and heat the system to 80° C. while adding liquid in which 40 parts of magnesium chloride hexahydrate are dissolved in 40 parts of deionized water to the resultant little by little while stirring.

Maintain the temperature at 80° C. until the agglomerated particles grow to 5.6 μm to obtain Slurry 13.

Manufacture Toner 13 having a volume average particle diameter of 5.6 μm in the same manner as in Example 1 except that Slurry 13 is used instead of Slurry 1 to evaluate the performance of the toner and the development agent.

Example 14

Manufacturing Example of Liquid Dispersion of Wax W2

Place and sufficiently dissolve 20 parts of Microcrystalline wax (Hi-Mic-1070, manufactured by Nippon Seiro Co., Ltd.) having a maximum endothermic peak temperature Wp (melting point) of melting heat of 60° C., a melting starting temperature Ws of 42° C., and a needle penetration degree of 20 at 25° C. and 80 parts of ethyl acetate in a reaction container equipped with a condenser, a stirrer, and a nitrogen introducing tube by heating to 78° C.

After cooling down the system to 30° C. in one hour while stirring, wet-pulverize the resultant in an Ultra Visco Mill, manufactured by AIMEX Co., Ltd.) under the condition of a liquid feeding speed of 1.0 Kg/h, a disk peripheral speed of 10 m/s, 0.5 mm zirconia bead filling amount of 80%, and a number of pass of 6 to obtain Liquid Dispersion of Wax W2.

Manufacturing Example of Toner 14

Place 39 parts of Crystalline Resin A2 and 39 parts of ethyl acetate in a container equipped with a thermometer and a stirrer and dissolve them by heating to the melting point of the resin or higher. Add 20 parts of Liquid Dispersion of Wax W2, 12 parts of Coloring Agent Master Batch P2, and 50 parts of ethyl acetate to the container followed by stirring by a TK type HOMOMIXER (manufactured by PRIMIX Corporation) at a rotation number of 10,000 rpm at 50° C. Add 90 parts of 50% by weight ethyl acetate solution of Crystalline Resin Precursor B2 to the container followed by a TK type HOMOMIXER (manufactured by PRIMIX Corporation) at a rotation number of 10,000 rpm for uniform dissolution and dispersion to obtain Oil Phase 14.

Manufacture Toner 14 having a volume average particle diameter of 5.5 μm in the same manner as in Example 11 except that Oil Phase 14 is used instead of Oil Phase 11 to evaluate the performance of the toner and the development agent.

Example 15

Manufacturing Example of Liquid Dispersion of Wax W3

Place and sufficiently dissolve 8 parts of Microcrystalline wax (Hi-Mic-2095, manufactured by Nippon Seiro Co., Ltd.) having a maximum endothermic peak temperature Wp (melting point) of melting heat of 82° C., a melting starting temperature Ws of 64° C., and a needle penetration degree of 20 at 25° C. and 80 parts of ethyl acetate in a reaction container equipped with a condenser, a stirrer, and a nitrogen introducing tube by heating to 78° C. After cooling down the system to 30° C. in one hour while stirring, wet-pulverize the resultant in an Ultra Visco Mill, manufactured by AIMEX Co., Ltd.) under the condition of a liquid feeding speed of 1.0 Kg/h, a disk peripheral speed of 10 m/s, 0.5 mm zirconia bead filling amount of 80%, and a number of pass of 6 to obtain Liquid Dispersion of Wax W3.

Manufacturing Example of Toner 15

Place 39 parts of Crystalline Resin A1 and 39 parts of ethyl acetate in a container equipped with a thermometer and a stirrer and dissolve them by heating to the melting point of the resin or higher. Add 20 parts of Liquid Dispersion of Wax W3, 12 parts of Coloring Agent Master Batch P1, and 50 parts of ethyl acetate to the container followed by stirring by a TK type HOMOMIXER (manufactured by PRIMIX Corporation) at a rotation number of 10,000 rpm at 50° C. Add 90 parts of 50% by weight ethyl acetate solution of Crystalline Resin Precursor B2 to the container followed by a TK type HOMOMIXER (manufactured by PRIMIX Corporation) at a rotation number of 10,000 rpm for uniform dissolution and dispersion to obtain Oil Phase 15.

Manufacture Toner 15 having a volume average particle diameter of 5.6 μm in the same manner as in Example 11 except that Oil Phase 15 is used instead of Oil Phase 11 to evaluate the performance of the toner and the development agent.

Example 16

Manufacturing Example of Liquid Dispersion of Wax W4

Place and sufficiently dissolve 20 parts of Microcrystalline wax (Hi-Mic-2065, manufactured by Nippon Seiro Co., Ltd.) having a maximum endothermic peak temperature Wp (melting point) of melting heat of 58° C., a melting starting temperature Ws of 39° C., and a needle penetration degree of 13 at 25° C. and 80 parts of ethyl acetate in a reaction container equipped with a condenser, a stirrer, and a nitrogen introducing tube by heating to 78° C.

After cooling down the system to 30° C. in one hour while stirring, wet-pulverize the resultant in an Ultra Visco Mill, manufactured by AIMEX Co., Ltd.) under the condition of a liquid feeding speed of 1.0 Kg/h, a disk peripheral speed of 10 m/s, 0.5 mm zirconia bead filling amount of 80%, and a number of pass of 6 to obtain Liquid Dispersion of Wax W4.

Manufacturing Example of Toner 16

Place 39 parts of Crystalline Resin A2 and 39 parts of ethyl acetate in a container equipped with a thermometer and a stirrer and dissolve them by heating to the melting point of the resin or higher. Add 20 parts of Liquid Dispersion of Wax W4, 12 parts of Coloring Agent Master Batch P2, and 50 parts of ethyl acetate to the container followed by stirring by a TK type HOMOMIXER (manufactured by PRIMIX Corporation) at a rotation number of 10,000 rpm at 50° C.

Add 90 parts of 50% by weight ethyl acetate solution of Crystalline Resin Precursor B2 to the container followed by a TK type HOMOMIXER (manufactured by PRIMIX Corporation) at a rotation number of 10,000 rpm for uniform dissolution and dispersion to obtain Oil Phase 16.

Manufacture Toner 16 having a volume average particle diameter of 5.7 μm in the same manner as in Example 11 except that Oil Phase 16 is used instead of Oil Phase 11 to evaluate the performance of the toner and the development agent.

Example 17

Manufacturing Example of Toner 17

Place 36 parts of Crystalline Resin A2 and 36 parts of ethyl acetate in a container equipped with a thermometer and a stirrer and dissolve them by heating to the melting point of the resin or higher.

dd 50 parts of Liquid Dispersion of Wax W1, 12 parts of Coloring Agent Master Batch P2, and 32 parts of ethyl acetate to the container followed by stirring by a TK type HOMOMIXER (manufactured by PRIMIX Corporation) at a rotation number of 10,000 rpm at 50° C. Add 84 parts of 50% by weight ethyl acetate solution of Crystalline Resin Precursor B2 to the container followed by a TK type HOMOMIXER (manufactured by PRIMIX Corporation) at a rotation number of 10,000 rpm for uniform dissolution and dispersion to obtain Oil Phase 17.

Manufacture Toner 17 having a volume average particle diameter of 5.7 μm in the same manner as in Example 11 except that Oil Phase 17 is used instead of Oil Phase 11 to evaluate the performance of the toner and the development agent.

Example 18

The performance of the toner and the development agent is evaluated in the same manner as in Example 11 except that an image forming apparatus B remodeled based on the image forming apparatus A in such a manner that the latent electrostatic image bearing member, the charger, the development device, and the cleaner of the image forming apparatus A are integrated into a process cartridge detachably attachable to the image forming apparatus B is used instead of the image forming apparatus A.

Comparative Example 1

Manufacturing Example of Liquid Dispersion of Wax W5

Place and sufficiently dissolve 20 parts of paraffin wax (Be Square 180 White, manufactured by TOYO ADL CORPORATION) having a broad endotherm peak range such as a maximum endothermic peak temperature Wp (melting point) of melting heat of 67° C., a melting starting temperature Ws of 48° C., and a needle penetration degree of 10 at 25° C. and 80 parts of ethyl acetate in a reaction container equipped with a condenser, a stirrer, and a nitrogen introducing tube by heating to 78° C.

After cooling down the system to 30° C. in one hour while stirring, wet-pulverize the resultant in an Ultra Visco Mill, manufactured by AIMEX Co., Ltd.) under the condition of a liquid feeding speed of 1.0 Kg/h, a disk peripheral speed of 10 m/s, 0.5 mm zirconia bead filling amount of 80%, and a number of pass of 6 to obtain Liquid Dispersion of Wax W5.

Manufacturing Example of Toner 18

Place 39 parts of Crystalline Resin A 1 and 39 parts of ethyl acetate in a container equipped with a thermometer and a stirrer and dissolve them by heating to the melting point of the resin or higher. Add 90 parts of 50% by weight of Non-Crystalline Resin C1, 20 parts of Liquid Dispersion of Wax W5, 12 parts of Coloring Agent Master Batch P1, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 18.

Manufacture Toner 18 having a volume average particle diameter of 5.6 μm in the same manner as in Example 1 except that Oil Phase 18 is used instead of Oil Phase 1 to evaluate the performance of the toner and the development agent.

Comparative Example 2

Manufacturing Example of Liquid Dispersion of Wax W6

Place and sufficiently dissolve 20 parts of paraffin wax (HNP-11, manufactured by (Nippon Seiro Co., Ltd.) having a sharp endotherm peak range such as a maximum endothermic peak temperature Wp (melting point) of melting heat of 68° C., a melting starting temperature Ws of 63° C., and a needle penetration degree of 9° C. at 25° C. and 80 parts of ethyl acetate in a reaction container equipped with a condenser, a stirrer, and a nitrogen introducing tube by heating to 78° C.

After cooling down the system to 30° C. in one hour while stirring, wet-pulverize the resultant in an Ultra Visco Mill, manufactured by AMEX Co., Ltd.) under the condition of a liquid feeding speed of 1.0 Kg/h, a disk peripheral speed of 10 m/s, 0.5 mm zirconia bead filling amount of 80%, and a number of pass of 6 to obtain Liquid Dispersion of Wax W6.

Manufacturing Example of Toner 19

Place 39 parts of Crystalline Resin A1 and 39 parts of ethyl acetate in a container equipped with a thermometer and a stirrer and dissolve them by heating to the melting point of the resin or higher.

Add 90 parts of 50% by weight of Non-Crystalline Resin C1, 20 parts of Liquid Dispersion of Wax W6, 12 parts of Coloring Agent Master Batch P1, and 50 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 19.

Manufacture Toner 19 having a volume average particle diameter of 5.6 μm in the same manner as in Example 1 except that Oil Phase 19 is used instead of Oil Phase 1 to evaluate the performance of the toner and the development agent.

Comparative Example 3

Manufacturing Example of Toner 20

Place 39 parts of Crystalline Resin A2 and 39 parts of ethyl acetate in a container equipped with a thermometer and a stirrer and dissolve them by heating to the melting point of the resin or higher.

Add 20 parts of Liquid Dispersion of Wax W5, 12 parts of Coloring Agent Master Batch P2, and 50 parts of ethyl acetate to the container followed by stirring by a TK type HOMOMIXER (manufactured by PRIMIX Corporation) at a rotation number of 10,000 rpm at 50° C.

Add 90 parts of 50% by weight ethyl acetate solution of Crystalline Resin Precursor B2 to the container followed by a TK type HOMOMIXER (manufactured by PRIMIX Corporation) at a rotation number of 10,000 rpm for uniform dissolution and dispersion to obtain Oil Phase 20.

Manufacture Toner 20 having a volume average particle diameter of 5.6 μm in the same manner as in Example 11 except that Oil Phase 20 is used instead of Oil Phase 11 to evaluate the performance of the toner and the development agent.

Comparative Example 4

Manufacturing Example of Non-Crystalline Resin C3

Place 215 parts of an adduct of bisphenol A with 2 mols of propylene oxide, 132 parts of an adduct of bisphenol A with 2 mols of ethylene oxide, 100 parts of terephthalic acid, 26 parts of terephthalic acid, and 1.8 parts of tetrabuthoxide titanate as a condensing catalyst in a reaction container equipped with a condenser, a stirrer, and a nitrogen introducing tube to conduct reaction for six hours at 230° C. in a nitrogen atmosphere while distilling away produced water.

Next, conduct reaction for one hour with a reduced pressure of from 5 mmHg to 20 mmHg. Subsequent to cooling down to 180° C., put 5 parts of trimellitic anhydride and continue the reaction with a reduced pressure of from 5 mmHg to 20 mmHg until Mw reaches about 6,000.

Transfer 239 parts of the thus obtained non-crystalline resin to a reaction container equipped with a condenser, a stirrer, and a nitrogen introducing tube and add 250 parts of ethyl acetate and 47 parts of hexamethylene diisocyanate (HDI) thereto to conduct reaction at 80° C. in a nitrogen atmosphere for five hours.

Then, distill away ethyl acetate with a reduced pressure to obtain Non-Crystalline Resin C3 (polyester/polyurethane resin) having an Mw of about 20,000, a glass transition temperature of 54° C. and a maximum peak temperature of melting heat of 62° C.

Manufacturing Example of Non-Crystalline Resin B3

Place 142 parts of hexamethylene diamine (MI) and 150 parts of ethyl acetate in a reaction container equipped with a condenser, a stirrer, and a nitrogen introducing tube and add a resin solution in which 239 parts of Non-Crystalline Resin C3 is dissolved in 239 parts of ethyl acetate thereto to conduct reaction at 80° C. for five hours in a nitrogen atmosphere. 50% by weight of ethyl acetate solution of Non-Crystalline Resins Precursor B3 having an isocyanate group at an end is resultantly obtained.

Manufacturing Example of Coloring Agent Master Batch P6

Manufacture Coloring Agent Master Batch P6 in the same manner as in Coloring Agent Master Batch P1 of Example 1 except that Non-Crystalline Resin C3 is used instead of Crystalline Resin A1.

Manufacturing Example of Toner 21

Place 39 parts of Non-Crystalline Resin C3 and 39 parts of ethyl acetate in a container equipped with a thermometer and a stirrer and dissolve them by heating to the melting point of the resin or higher.

Add 20 parts of Liquid Dispersion of Wax W1, 12 parts of Coloring Agent Master Batch P6, and 50 parts of ethyl acetate to the container followed by stirring by a TK type HOMOMIXER (manufactured by PRIMIX Corporation) at a rotation number of 10,000 rpm at 50° C.

Add 90 parts of 50% by weight ethyl acetate solution of Non-Crystalline Resin Precursor B3 to the container followed by a TK type HOMOMIXER (manufactured by PRIMIX Corporation) at a rotation number of 10,000 rpm for uniform dissolution and dispersion to obtain Oil Phase 21.

Manufacture Toner 21 having a volume average particle diameter of 5.8 μm in the same manner as in Example 11 except that Oil Phase 21 is used instead of Oil Phase 11 to evaluate the performance of the toner and the development agent.

Comparative Example 5

Manufacturing Example of Non-Crystalline Resin C4

Place 215 parts of an adduct of bisphenol A with 2 mols of propylene oxide, 132 parts of an adduct of bisphenol A with 2 mols of ethylene oxide, 100 parts of terephthalic acid, 26 parts of terephthalic acid, and 1.8 parts of tetrabuthoxide titanate as a condensing catalyst in a reaction container equipped with a condenser, a stirrer, and a nitrogen introducing tube to conduct reaction for six hours at 230° C. in a nitrogen atmosphere while distilling away produced water.

Next, conduct reaction for one hour with a reduced pressure of from 5 mmHg to 20 mmHg.

Subsequent to cooling down to 180° C., put 5 parts of trimellitic anhydride and continue the reaction with a reduced pressure of from 5 mmHg to 20 mmHg until Mw reaches about 22,000 to obtain Non-Crystalline Resin C4 (polyester resin) having a glass transition temperature of 52° C. and a maximum peak temperature of melting heat of 60° C.

Manufacturing Example of Non-Crystalline Resin B4

Place 142 parts of hexamethylene diamine (HDI) and 150 parts of ethyl acetate in a reaction container equipped with a condenser, a stirrer, and a nitrogen introducing tube and add a resin solution in which 239 parts of Non-Crystalline Resin C4 is dissolved in 239 parts of ethyl acetate thereto to conduct reaction at 80° C. for five hours in a nitrogen atmosphere to obtain 50% by weight of ethyl acetate solution of Non-Crystalline Resins Precursor B4 having an isocyanate group at an end.

Manufacturing Example of Coloring Agent Master Batch P7

Manufacture Coloring Agent Master Batch P7 in the same manner as in Coloring Agent Master Batch P1 of Example 1 except that Non-Crystalline Resin C4 is used instead of Crystalline Resin A1.

Manufacturing Example of Toner 22

Place 39 parts of Non-Crystalline Resin C4 and 39 parts of ethyl acetate in a container equipped with a thermometer and a stirrer and dissolve them by heating to the melting point of the resin or higher.

Add 20 parts of Liquid Dispersion of Wax W1, 12 parts of Coloring Agent Master Batch P7, and 50 parts of ethyl acetate to the container followed by stirring by a TK type HOMOMIXER (manufactured by PRIMIX Corporation) at a rotation number of 10,000 rpm at 50° C.

Add 90 parts of 50% by weight ethyl acetate solution of Non-Crystalline Resin Precursor B4 to the container followed by a TK type HOMOMIXER (manufactured by PRIMIX Corporation) at a rotation number of 10,000 rpm for uniform dissolution and dispersion to obtain Oil Phase 22.

Manufacture Toner 22 having a volume average particle diameter of 5.6 μm in the same manner as in Example 11 except that Oil Phase 22 is used instead of Oil Phase 11 to evaluate the performance of the toner and the development agent

Comparative Example 6

Manufacturing Example of Toner 23

Place 36 parts of Crystalline Resin A1 and 36 parts of ethyl acetate in a container equipped with a thermometer and a stirrer and dissolve them by heating to the melting point of the resin or higher. Add 84 parts of 50% by weight of Non-Crystalline Resin C1, 50 parts of Liquid Dispersion of Wax W5, 12 parts of Coloring Agent Master Batch P1, and 32 parts of ethyl acetate to the container followed by stirring by a TK type HOMOMIXER (manufactured by PRIMIX Corporation) at a rotation number of 10,000 rpm at 50° C. for uniform dissolution and dispersion to obtain Oil Phase 23.

Manufacture Toner 23 having a volume average particle diameter of 5.6 μm in the same manner as in Example 1 except that Oil Phase 23 is used instead of Oil Phase 1 to evaluate the performance of the toner and the development agent.

The ratios of C/(A+C) for each toner are shown in Table 3.

TABLE 1

| Sample name | | Glass transition temperature (° C.) | Maximum peak temperature Ta (° C.) of melting heat | Softening point Tb (° C.) | Tb/Ta | Weight average molecular weight Mw |
|---|---|---|---|---|---|---|
| Crystalline resin | A1 | — | 60 | 61 | 1.02 | 22,000 |
| | A2 | — | 65 | 75 | 1.15 | 20,000 |
| | A3 | — | 68 | 81 | 1.19 | 18,000 |
| | A4 | — | 52 | 58 | 1.12 | 11,000 |
| | A5 | — | 59 | 69 | 1.18 | 18,000 |
| | B2 | — | 65 | 76 | 1.17 | 20,000 |
| Non-crystalline resin | C1 | 61 | 65 | 137 | 2.11 | 7,600 |
| | C2 | 60 | 68 | 144 | 2.11 | 10,000 |
| | C3 | 54 | 62 | 152 | 2.45 | 20,000 |
| | C4 | 52 | 60 | 135 | 2.25 | 22,000 |
| | B3 | 54 | 62 | 155 | 2.50 | 21,000 |
| | B4 | 53 | 60 | 137 | 2.28 | 22,000 |

TABLE 2

| | | | | Releasing agent | | | | |
|---|---|---|---|---|---|---|---|---|
| | Toner | Mfg. method | Maximum Peak temp. T (° C.) of melting heat of toner | Kind | Content amount in toner (% by weight) | Maximum Peak temp. Wp (° C.) of melting heat of releasing agent | Melting starting temp. Ws (° C.) | Penetration degree |
| Ex. 1 | Toner 1 | Dis/Sus. method | 59 | Micro-crystalline wax | 4 | 69 | 57 | 5 |
| Ex. 2 | Toner 2 | Dis/Sus. method | 58 | Micro-crystalline wax | 4 | 69 | 57 | 5 |
| Ex. 3 | Toner 3 | Dis/Sus. method | 63 | Micro-crystalline wax | 4 | 69 | 57 | 5 |
| Ex. 4 | Toner 4 | Dis/Sus. method | 67 | Micro-crystalline wax | 4 | 69 | 57 | 5 |
| Ex. 5 | Toner 5 | Dis/Sus. method | 52 | Micro-crystalline wax | 4 | 69 | 57 | 5 |
| Ex. 6 | Toner 6 | Dis/Sus. method | 59 | Micro-crystalline wax | 4 | 69 | 57 | 5 |
| Ex. 7 | Toner 7 | Dis/Sus. method | 59 | Micro-crystalline wax | 4 | 69 | 57 | 5 |
| Ex. 8 | Toner 8 | Dis/Sus. method | 65 | Micro-crystalline wax | 4 | 69 | 57 | 5 |
| Ex. 9 | Toner 9 | Dis/Sus. method | 65 | Micro-crystalline wax | 4 | 69 | 57 | 5 |
| Ex. 10 | Toner 10 | Dis/Sus. method | 65 | Micro-crystalline wax | 4 | 69 | 57 | 5 |
| Ex. 11 | Toner 11 | Dis/Sus. method | 66 | Micro-crystalline wax | 4 | 69 | 57 | 5 |
| Ex. 12 | Toner 12 | Pulverization. method | 58 | Micro-crystalline wax | 4 | 69 | 57 | 5 |

TABLE 2-continued

| | | | | | | | | |
|---|---|---|---|---|---|---|---|---|
| Ex. 13 | Toner 13 | Agglomeration method | 59 | Micro-crystalline wax | 4 | 69 | 57 | 5 |
| Ex. 14 | Toner 14 | Dis/Sus. method | 66 | Micro-crystalline wax | 4 | 60 | 42 | 20 |
| Ex. 15 | Toner 15 | Dis/Sus. method | 61 | Micro-crystalline wax | 4 | 82 | 64 | 8 |
| Ex. 16 | Toner 16 | Dis/Sus. method | 66 | Micro-crystalline wax | 4 | 58 | 39 | 13 |
| Ex. 17 | Toner 17 | Dis/Sus. method | 66 | Micro-crystalline wax | 10 | 69 | 57 | 5 |
| Ex. 18 | Toner 11 | — | — | — | — | — | — | — |
| Comp. Ex. 1 | Toner 18 | Dis/Sus. method | 59 | Paraffin wax | 4 | 67 | 48 | 10 |
| Comp. Ex. 2 | Toner 19 | Dis/Sus. method | 59 | Paraffin wax | 4 | 68 | 63 | 9 |
| Comp. Ex. 3 | Toner 20 | Dis/Sus. method | 66 | Paraffin wax | 4 | 67 | 48 | 10 |
| Comp. Ex. 4 | Toner 21 | Dis/Sus. method | 60 | Micro-crystalline wax | 4 | 69 | 57 | 5 |
| Comp. Ex. 5 | Toner 22 | Dis/Sus. method | 60 | Micro-crystalline wax | 4 | 69 | 57 | 5 |
| Comp. Ex. 6 | Toner 23 | Dis/Sus. method | 59 | Paraffin wax | 10 | 67 | 48 | 10 |

| | Crystalline resin 1 | | Crystalline resin 2 | | Non-crystalline resin 1 | | Non-crystalline resin 2 | |
|---|---|---|---|---|---|---|---|---|
| | Kind | Content in binder resin (% by weight) | Kind | Content in binder resin (% by weight) | Kind | Content in binder resin (% by weight) | Kind | Content in binder resin (% by weight) |
| Ex. 1 | A1 | 50 | | | C1 | 50 | | |
| Ex. 2 | A1 | 100 | | | | | | |
| Ex. 3 | A2 | 50 | | | C1 | 50 | | |
| Ex. 4 | A3 | 50 | | | C1 | 50 | | |
| Ex. 5 | A4 | 50 | | | C1 | 50 | | |
| Ex. 6 | A1 | 50 | | | C2 | 50 | | |
| Ex. 7 | A5 | 50 | | | C1 | 50 | | |
| Ex. 8 | A2 | 66 | | | C1 | 34 | | |
| Ex. 9 | A2 | 80 | | | C1 | 20 | | |
| Ex. 10 | A2 | 100 | | | | | | |
| Ex. 11 | A2 | 50 | B2 | 50 | | | | |
| Ex. 12 | A1 | 50 | | | C1 | 50 | | |
| Ex. 13 | A1 | 50 | | | C1 | 50 | | |
| Ex. 14 | A2 | 50 | B2 | 50 | | | | |
| Ex. 15 | A1 | 50 | B2 | 50 | | | | |
| Ex. 16 | A2 | 50 | B2 | 50 | | | | |
| Ex. 17 | A2 | 50 | B2 | 50 | | | | |
| Ex. 18 | — | — | | | | | | |
| Comp. Ex. 1 | A1 | 50 | | | C1 | 50 | | |
| Comp. Ex. 2 | A1 | 50 | | | Cl | 50 | | |
| Comp. Ex. 3 | A2 | 50 | B2 | 50 | | | | |
| Comp. Ex. 4 | | | | | C3 | 50 | B3 | 50 |
| Comp. Ex. 5 | | | | | C4 | 50 | B4 | 50 |
| Comp. Ex. 6 | A1 | 50 | | | C1 | 50 | | |

Dis/Sus method: Dissolution suspension method

TABLE 3

| | Toner | Image forming apparatus | Ratio C/(A + C) | Lowest fixing temperature (° C.) | Fixable temperature range (° C.) | High temperature stability | Abrasion resistance |
|---|---|---|---|---|---|---|---|
| Ex. 1 | Toner 1 | A | 0.22 | 105 | 80 | G | 4.5 |
| Ex. 2 | Toner 2 | A | 0.57 | 105 | 90 | E | 4.0 |
| Ex. 3 | Toner 3 | A | 0.23 | 110 | 90 | E | 4.5 |
| Ex. 4 | Toner 4 | A | 0.16 | 115 | 95 | E | 4.5 |
| Ex. 5 | Toner 5 | A | 0.15 | 120 | 70 | E | 4.5 |
| Ex. 6 | Toner 6 | A | 0.23 | 110 | 90 | G | 4.5 |
| Ex. 7 | Toner 7 | A | 0.18 | 135 | 85 | G | 4.5 |
| Ex. 8 | Toner 8 | A | 0.28 | 110 | 90 | E | 4.5 |
| Ex. 9 | Toner 9 | A | 0.31 | 110 | 90 | E | 4.5 |
| Ex. 10 | Toner 10 | A | 0.39 | 105 | 95 | E | 4.5 |
| Ex. 11 | Toner 11 | A | 0.37 | 105 | 110 | E | 5.0 |
| Ex. 12 | Toner 12 | A | 0.25 | 105 | 85 | F | 4.5 |
| Ex. 13 | Toner 13 | A | 0.22 | 105 | 80 | G | 4.5 |
| Ex. 14 | Toner 14 | A | 0.40 | 105 | 90 | G | 4.0 |
| Ex. 15 | Toner 15 | A | 0.54 | 110 | 115 | E | 4.0 |
| Ex. 16 | Toner 16 | A | 0.39 | 105 | 90 | E | 4.5 |
| Ex. 17 | Toner 17 | A | 0.42 | 100 | 115 | F | 5.0 |
| Ex. 18 | Toner 11 | B | 0.37 | 105 | 110 | E | 5.0 |
| Comp. Ex. 1 | Toner 18 | A | 0.23 | 110 | 70 | F | 2.0 |
| Comp. Ex. 2 | Toner 19 | A | 0.23 | 110 | 60 | G | 1.0 |
| Comp. Ex. 3 | Toner 20 | A | 0.38 | 115 | 105 | F | 2.5 |
| Comp. Ex. 4 | Toner 21 | A | 0.06 | 155 | 55 | G | 2.5 |
| Comp. Ex. 5 | Toner 22 | A | 0.05 | 145 | 40 | G | 1.5 |
| Comp. Ex. 6 | Toner 23 | A | 0.23 | 105 | 90 | VB | 2.0 |

What is claimed is:

1. A toner comprising:

a coloring agent;

a binder resin comprising an amount of 50% by weight or more of a crystalline resin having a urethane skeleton and/or urea skeleton; and a releasing agent comprising a microcrystalline wax wherein, in a diffraction spectrum of the toner obtained by X-ray diffraction, a ratio of C/(A+C) is 0.15 or greater, where C represents an integrated intensity of a spectrum deriving from a crystalline structure and A represents an integrated intensity of a spectrum deriving from a non-crystalline structure.

2. The toner according to claim 1, wherein the crystalline resin comprises a polyurethane resin obtained by elongating and/or cross-linking a di- or higher isocyanate compound and a polyester resin.

3. The toner according to claim 1, wherein the crystalline resin comprises a first crystalline resin and a second crystalline resin having a weight average molecular weight Mw greater than the first crystalline resin.

4. The toner according to claim 3, wherein the second crystalline resin is obtained by elongating a modified crystalline resin having an isocyanate group at an end.

5. The toner according to claim 3, wherein the second crystalline resin is obtained by elongating a modified crystalline resin which is modified from the first crystalline resin to have a functional group reactive with an active hydrogen group.

6. The toner according to claim 1, satisfying the following relationship:

$$Ws(° C.) \leq T(° C.) \leq Wp(° C.)$$

where T (° C.) represents a maximum peak temperature of melting heat of the toner measured by a differential scanning calorimeter (DSC), Wp (° C.) represents a maximum peak temperature of melting heat of the releasing agent measured by the DSC, and Ws (° C.) represents a melting starting temperature defined as a temperature at an intersection of a tangent to a DSC curve of the releasing agent measured by the DSC at a temperature at which a slope of the curve, which is a negative value, on a lower temperature side of Wp (° C.) is maximal and a straight line extrapolating a base line of the DSC curve of the releasing agent measured by the DSC.

7. The toner according to claim 1, wherein the releasing agent has a penetration degree of 15 or lower at 25° C.

8. A development agent comprising:

a carrier; and the toner of claim 1.

9. An image forming apparatus comprising:

a latent electrostatic image bearing member;

a charger to charge a surface of the latent electrostatic image bearing member;

an irradiator to irradiate the surface of the latent electrostatic image with light to form a latent electrostatic image thereon;

a development device to develop the latent electrostatic image with the development agent of claim 8 to form a visual image;

a transfer device to transfer the visual image to a recording medium to form a transfer image thereon; and a fixing device to fix the transfer image on the recording medium.

10. A process cartridge comprising:

a latent electrostatic image bearing member to bear a latent electrostatic image; and a development device to develop the latent electrostatic image with the development agent of claim 8 to form a visual image, wherein the process cartridge is detachably attachable to an image forming apparatus.

11. The toner according to claim 1, wherein the binder resin comprising a crystalline resin having a urethane skeleton and/or urea skeleton in an amount of 65% by weight or more based on a weight of said binder resin.

12. The toner according to claim 1, wherein the binder resin comprising a crystalline resin having a urethane skeleton and/or urea skeleton in an amount of 80% by weight or more based on a weight of said binder resin.

13. The toner according to claim 1, wherein the binder resin comprising a crystalline resin having a urethane skeleton and/or urea skeleton in an amount of 95% by weight or more based on a weight of said binder resin.

14. The toner according to claim 1, wherein a content of binder resin in said toner is 50 parts or more based on 100 parts of said toner.

15. The toner according to claim 1, wherein a ratio of C/(A+C) is 0.20.

16. The toner according to claim 1, wherein a ratio of C/(A+C) is 0.30.

17. The toner according to claim 1, wherein a ratio of C/(A+C) is 0.45.

18. The toner according to claim 1, wherein said crystalline resin has a maximum peak temperature of the melting heat of from 45° to 70° C.

19. The toner according to claim 1, wherein a ratio of a softening temperature to a maximum peak temperature of a melting heat of said crystalline resin is from 0.8 to 1.55.

* * * * *